US008707644B2

(12) United States Patent
Degen et al.

(10) Patent No.: US 8,707,644 B2
(45) Date of Patent: Apr. 29, 2014

(54) CONCRETE FLOORING SYSTEM FORMWORK ASSEMBLY HAVING TRIANGULAR SUPPORT STRUCTURE

(75) Inventors: Ronald Jean Degen, Santiago (CL); Fausto Bejarano Castillo, San Jose (CR); Humberto Trimino Vasquez, San Jose (CR); Pablo Rodriguez Acosta, San Jose (CR)

(73) Assignee: The Plycem Company Inc., Cartago (CR)

( * ) Notice: Subject to any disclaimer, the term of this patent is extended or adjusted under 35 U.S.C. 154(b) by 0 days.

(21) Appl. No.: 13/450,868

(22) Filed: Apr. 19, 2012

(65) Prior Publication Data

US 2013/0031862 A1 Feb. 7, 2013

Related U.S. Application Data

(63) Continuation of application No. 11/873,634, filed on Oct. 17, 2007, now abandoned.

(60) Provisional application No. 60/862,518, filed on Oct. 23, 2006.

(51) Int. Cl.
*E04B 5/38* (2006.01)

(52) U.S. Cl.
CPC ..... *E04B 5/38* (2013.01)
USPC ..... 52/309.12; 52/309.17; 52/414

(58) Field of Classification Search
USPC ..... 52/309.7, 309.8, 309.12, 309.16, 52/309.17, 414, 333, 335, 352
See application file for complete search history.

(56) References Cited

U.S. PATENT DOCUMENTS

| | | | | |
|---|---|---|---|---|
| 1,052,788 | A | 2/1913 | Bates | |
| 1,616,977 | A | 2/1927 | Koivu | |
| 1,762,099 | A | 6/1930 | Phillips | |
| 1,833,875 | A | 11/1931 | Lockwood | |
| 2,061,281 | A | 11/1936 | Lawlor | |
| 3,160,245 | A | 12/1964 | Pavlecka | |
| 3,191,726 | A | 6/1965 | Paviecka | |
| 3,238,684 | A | 3/1966 | Wood | |
| 3,383,817 | A | 5/1968 | Gregorl | |
| 3,530,634 | A | 9/1970 | Adams | |
| 3,552,076 | A | 1/1971 | Gregorl | |
| 3,788,020 | A | 1/1974 | Gregori | |
| 3,882,653 | A * | 5/1975 | Ollman | 52/694 |

(Continued)

FOREIGN PATENT DOCUMENTS

| | | |
|---|---|---|
| ES | 2 063 634 A2 | 3/1992 |
| GB | 1 277 816 | 6/1972 |

(Continued)

*Primary Examiner* — Michael Safavi
(74) *Attorney, Agent, or Firm* — Dorsey & Whitney LLP; Nathaniel P. Longley

(57) ABSTRACT

A floor formwork system is disclosed. The floor formwork system comprises a form member having a reinforcement beam attached to a surface of the form member. The reinforcement beam of the floor formwork system is positioned and attached in grooves within or on the contact surface of the form member. The reinforcement beam comprises a plurality of longitudinal rods or members, one or more of which are connected by a diagonal support member. Concrete is added to the assembled form member and reinforcement beam so as to create a floor or ceiling, or other structure. A method of assembling the formwork system and use for preparation for a floor or ceiling is also disclosed.

21 Claims, 23 Drawing Sheets

(56) References Cited

U.S. PATENT DOCUMENTS

| | | | | | |
|---|---|---|---|---|---|
| 3,922,833 | A | | 12/1975 | Eaton | |
| 3,959,940 | A | | 6/1976 | Ramberg | |
| 4,203,788 | A | * | 5/1980 | Clear | 156/44 |
| 4,223,501 | A | | 9/1980 | DeLozier | |
| 4,231,203 | A | | 11/1980 | Mikkelsen et al. | |
| 4,295,312 | A | * | 10/1981 | Campbell | 52/408 |
| 4,433,520 | A | | 2/1984 | Maschhoff | |
| 4,637,187 | A | * | 1/1987 | Campbell | 52/404.3 |
| 4,741,139 | A | * | 5/1988 | Campbell | 52/694 |
| 4,773,199 | A | | 9/1988 | Kohara | |
| 4,889,310 | A | | 12/1989 | Boeshart | |
| 5,035,099 | A | | 7/1991 | Lapish | |
| 5,086,600 | A | | 2/1992 | Holland et al. | |
| 5,107,648 | A | | 4/1992 | Roby | |
| 5,235,791 | A | * | 8/1993 | Yaguchi | 52/414 |
| 5,337,534 | A | | 8/1994 | Nasca | |
| 5,448,866 | A | * | 9/1995 | Saito et al. | 52/414 |
| 5,459,970 | A | | 10/1995 | Kim | |
| 5,596,855 | A | | 1/1997 | Batch | |
| 5,611,183 | A | | 3/1997 | Kim | |
| 5,695,676 | A | | 12/1997 | Lee | |
| 5,704,180 | A | | 1/1998 | Boeck | |
| 5,761,866 | A | * | 6/1998 | Maylon | 52/366 |
| 5,782,050 | A | | 7/1998 | Boeshart | |
| 5,809,728 | A | | 9/1998 | Tremelling | |
| 5,857,300 | A | | 1/1999 | Gates | |
| 5,881,524 | A | | 3/1999 | Ellison, Jr. | |
| 5,918,427 | A | | 7/1999 | VanderWerf | |
| 5,930,970 | A | | 8/1999 | De Le fevre | |
| 5,956,922 | A | | 9/1999 | Liuska | |
| 6,076,323 | A | | 6/2000 | Chiu | |
| 6,151,856 | A | | 11/2000 | Shimonohara | |
| D435,212 | S | | 12/2000 | Philippe | |
| 6,231,024 | B1 | | 5/2001 | Kugimiya et al. | |
| 6,247,280 | B1 | | 6/2001 | Grinshpun et al. | |
| 6,263,631 | B1 | | 7/2001 | Nisbett et al. | |
| 6,352,237 | B1 | | 3/2002 | Severino | |
| 6,397,552 | B1 | | 6/2002 | Bourque | |
| 6,481,178 | B2 | | 11/2002 | Moore, Jr. | |
| 6,536,172 | B1 | | 3/2003 | Amend | |
| 6,681,539 | B2 | | 1/2004 | Yost et al. | |
| 6,865,857 | B1 | | 3/2005 | Adell Argiles | |
| 6,880,308 | B2 | * | 4/2005 | Seiz et al. | 52/694 |
| 6,892,498 | B1 | | 5/2005 | Roman | |
| 6,895,720 | B2 | | 5/2005 | Keith | |
| 6,931,806 | B2 | | 8/2005 | Olsen | |
| 6,935,081 | B2 | | 8/2005 | Dunn et al. | |
| 7,082,732 | B2 | | 8/2006 | Titishov | |
| 7,160,061 | B2 | * | 1/2007 | Nickelson et al. | 405/279 |
| 7,188,747 | B2 | * | 3/2007 | Bennett et al. | 220/565 |
| 7,320,201 | B2 | | 1/2008 | Kitchen et al. | |
| 7,337,591 | B2 | | 3/2008 | Molina | |
| 7,516,589 | B2 | | 4/2009 | Messiqua et al. | |
| 7,757,448 | B2 | | 7/2010 | Zhu | |
| 8,375,669 | B2 | | 2/2013 | Krayenhoff | |
| 2004/0200176 | A1 | | 10/2004 | Olsen | |
| 2004/0226259 | A1 | | 11/2004 | Barnet et al. | |
| 2005/0229536 | A1 | | 10/2005 | Yoshii et al. | |

FOREIGN PATENT DOCUMENTS

| | | | |
|---|---|---|---|
| WO | WO 93/22905 | A1 | 11/1993 |
| WO | WO 99/22096 | A1 | 5/1999 |
| WO | WO 2005/042875 | A1 | 5/2005 |
| WO | WO 2005/068748 | A2 | 7/2005 |
| WO | WO 2007/131279 | A1 | 11/2007 |

* cited by examiner

FIG. 14
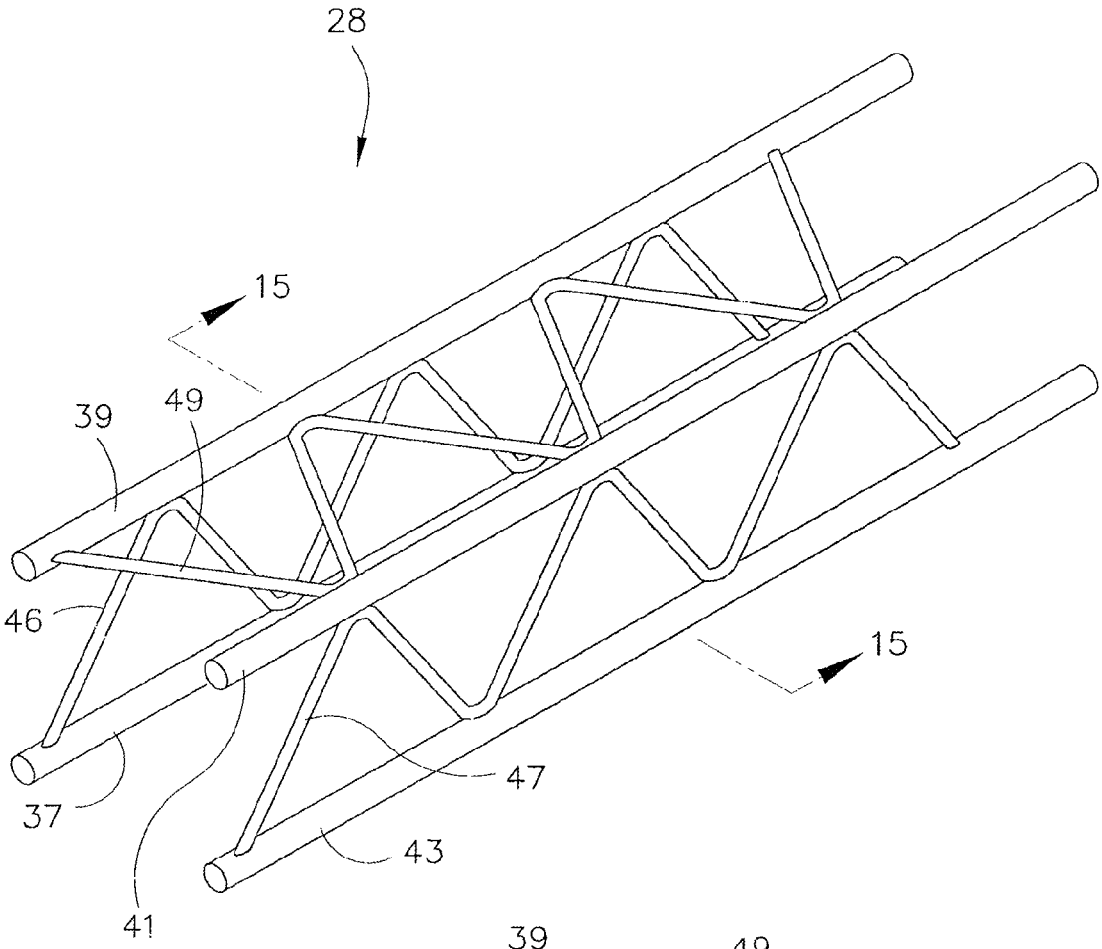
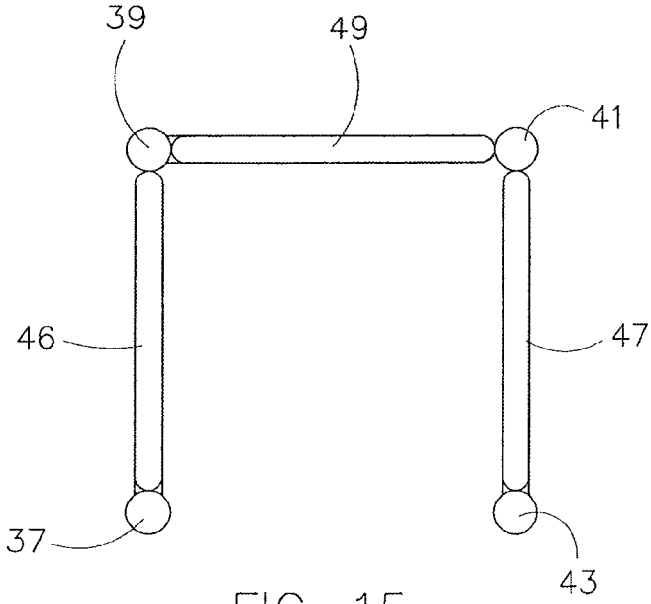
FIG. 15

FIG. 16
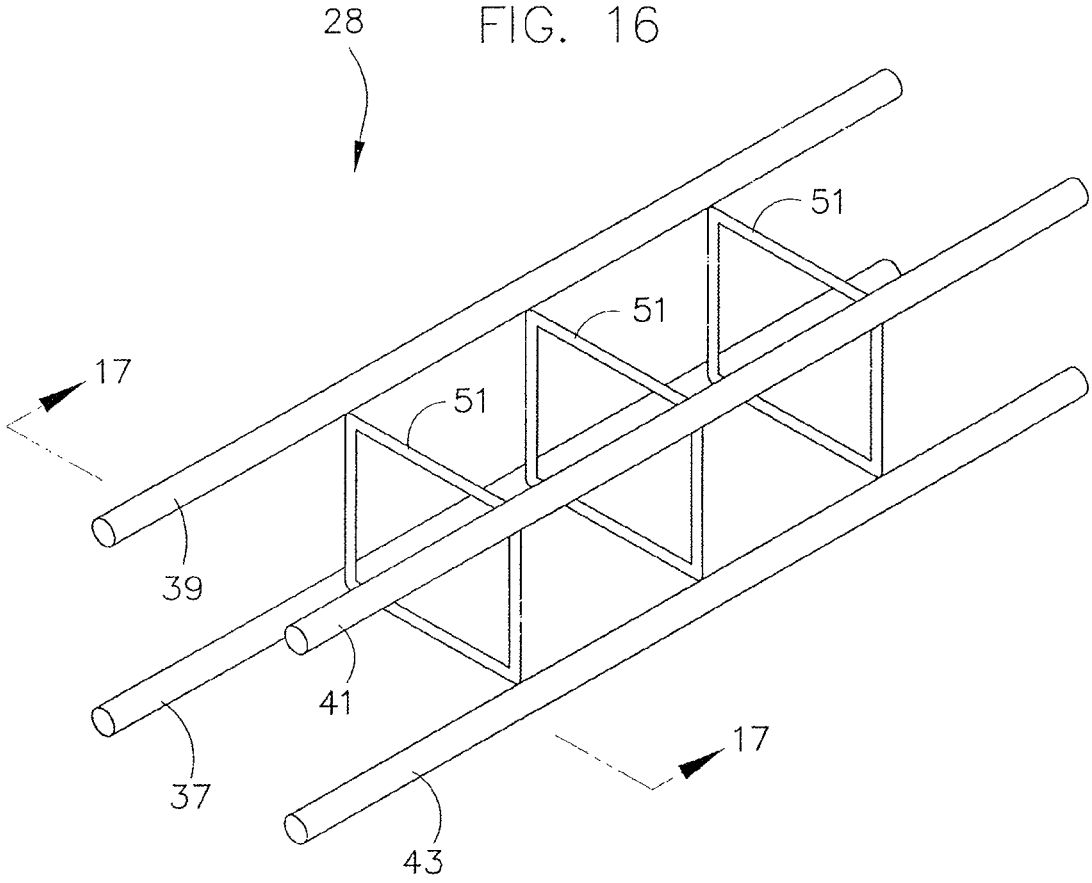
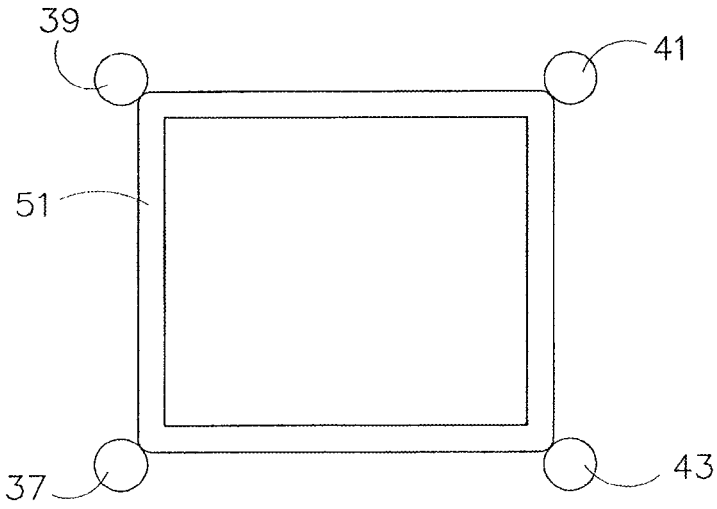
FIG. 17

CONCRETE FLOORING SYSTEM FORMWORK ASSEMBLY HAVING TRIANGULAR SUPPORT STRUCTURE

CROSS REFERENCE TO RELATED APPLICATION(s)

This application is a continuation of U.S. application Ser. No. 11/873,634, filed Oct. 17, 2007 now abandoned, which claims benefit of U.S. Provisional Application Ser. No. 60/862,518, filed on Oct. 23, 2006, entitled "Flooring System", the contents of all of which are incorporated by reference herein in their entirety for all purposes.

FIELD OF INVENTION

This invention relates to concrete forming structures for floors.

BACKGROUND

Concrete forming systems are known. Concrete has various advantages in that it has a proven record for strength, durability, and cost effectiveness for a variety of applications including, for example, floors. Concrete floors are found in a variety of residential and commercial settings. Interior concrete is often covered with carpet or other flooring materials. Concrete can also be decorated or treated to create a variety of hues and textures.

Likewise, flooring systems are also known. Often, a flooring system is composed of a combination of girders, joists, sub-flooring, and finished flooring that may be made up of a variety of substances, such as concrete, steel, or wood. In common flooring systems, joists are laid perpendicular to the girders and sub-flooring is attached to the joists. The girders are often used to support the joists and are typically found in framing systems where there are no interior bearing walls or where the span between bearing walls is to great for the joists. The girder may be supported by posts or columns made of wood or steel that often extend from the floor below.

Outer barriers, such as walls and other formworks or structures are typically used to retain the concrete floor slab in location as the concrete is poured. In order to construct a floor or ceiling, a supporting material may be used to support the concrete which is poured thereon. In building construction, it is also common to include a web or mesh of reinforcing material such as rebar between the form members prior to adding the concrete, which is then engulfed by the concrete to provide strength to the hardened concrete structure along the weak axis of the solidified concrete. Typically, a concrete floor slab must be provided on a uniform level surface, must provide sufficient strength and stability, must avoid dampness, must provide a certain degree of thermal insulation, and must be resistant to fire. A common arrangement for a concrete floor slab includes a consolidated hardcore that supports sand blinding covered by a damp proof membrane. On top of the membrane, insulation may be provided upon which the concrete slab and subsequently the floor screed may be added. In some instances in building construction, a floor system may include a concrete floor slab that is supported by reinforced concrete beams. Alternatively, wooden beam forms with wooden or metal decks spanning the beam forms may often be used. In some instances, corrugated metal deck members having alternating ribs and valleys and an overlying layer of concrete have been used to prepare floors.

In preparing multi-story concrete buildings, means for supporting concrete formwork during the construction of the building must be provided. These systems often employ fixed or movable scaffolding supported from the floor below, upon which the formwork for the next floor is placed. Steel reinforcements, such as rebar or other steel fibers, may be added to the concrete to further strengthen the floor slab.

The foregoing systems, however, suffer drawbacks. These structures often comprise numerous components, components that must be used and discarded, and components which are difficult to assemble, making assembly of the complete structure both time consuming and costly. Moreover, concrete floor forming systems often-times lack strength to support a significant load or resist stresses thereon.

In view of the foregoing, a need exists for a formwork flooring system which is both easy to assemble and has significant structural strength.

SUMMARY OF THE INVENTION

A floor formwork system is disclosed. The floor formwork system comprises a form member having a contact surface and a reinforcement beam monolithically attached to the contact surface of the form member. A plurality of form members and/or reinforcement beams may be provided. Concrete is further added to the assembled form member and reinforcement beam so as to create a floor or ceiling, or other structure. Often times, the form members are positioned between walls and/or beams so that a confined area is formed for the placement of concrete. The formwork assemblies may be attached end-to-end or may be attached adjacently so as to form a plurality of structures making up a single structural surface, for supporting a floor or ceiling. A floor or ceiling is created by placing the concrete on the assembled formwork system.

The reinforcement beam of the floor formwork system is positioned and attached in grooves within, or on, the contact surface of the form member. The reinforcement beam comprises a plurality of longitudinal rods or members, one or more of which may be connected by a diagonal support member, or more preferably a web of triangular struts made up of a plurality of diagonal support members.

A method of assembling the formwork system and use for preparation of a floor or ceiling is also disclosed. The method generally includes the steps of attaching one or more reinforcement beams to one or more form members. One or more form members may be connected together, either before or after the attachment of the reinforcement beam(s). In a preferred embodiment, the assembled formwork assemblies may be transported to the building site, placed in their corresponding position on the supports for the foundation or floor slabs and attached to other structural components. Once the assembled formwork system is in position for formation of the floor, ceiling or other structure, concrete is placed in contact with the formwork assembly.

Other aspects, features and details of the present invention can be more completely understood by reference to the following detailed description in conjunction with the drawings, and from the appended claims.

BRIEF DESCRIPTION OF THE DRAWINGS

FIG. 14 is a perspective view of a reinforcement beam in an alternative embodiment of the formwork system.

FIG. 15 is a cross-sectional view of the embodiment of the reinforcement beam shown in FIG. 14, taken along line 15-15 of FIG. 14.

FIG. 16 is a perspective view of a reinforcement beam in an alternative embodiment of the formwork system.

FIG. 17 is a cross-sectional view of the embodiment of the reinforcement beam shown in FIG. 16, taken along line 17-17 of FIG. 16.

DETAILED DESCRIPTION OF PREFERRED EMBODIMENTS

As can be seen from the Figures a floor formwork system is provided. The floor formwork system comprises a formwork assembly having one or more form members with attached reinforcement beam(s). The formwork assembly presents a strong, rigid, support structure for receiving and supporting concrete, the combination of which forms a floor, ceiling or other structure.

A method of forming a floor using the formwork system is also provided. The method, generally, in its most basic form, comprises providing a form member and a reinforcement beam. The reinforcement beam is placed in contact with the form member on a contact surface thereof. The reinforcement beam is secured to the form member. Concrete is then added to the formwork assembly, in contact with the contact surface of the form member and in contact with the reinforcement beam. The concrete is allowed to harden, which results in the formation of a floor having an attached form member and including the reinforcement beam therein.

It is noted that while a "floor" is specifically discussed herein, it is contemplated that the formwork system may be applied to floors, ceilings, walls and other structures. Likewise, "form" and "beam" are specifically referenced herein for ease of reference. However, one of skill in the art would understand that other terminology and/or structures may be suitable for the purposes provided.

Figure 1:
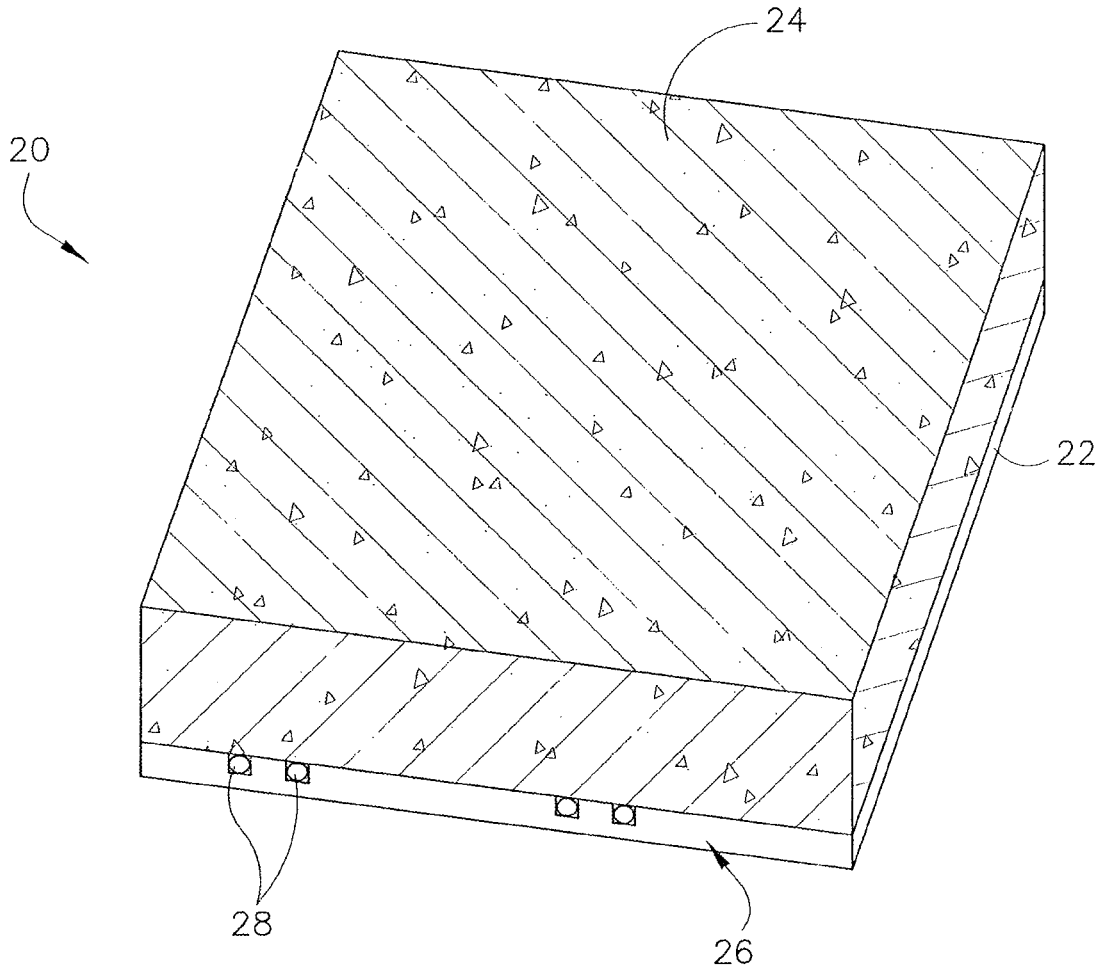
FIG. 1 is a perspective view of a floor in an embodiment of the flooring system described herein.
Figure 2:
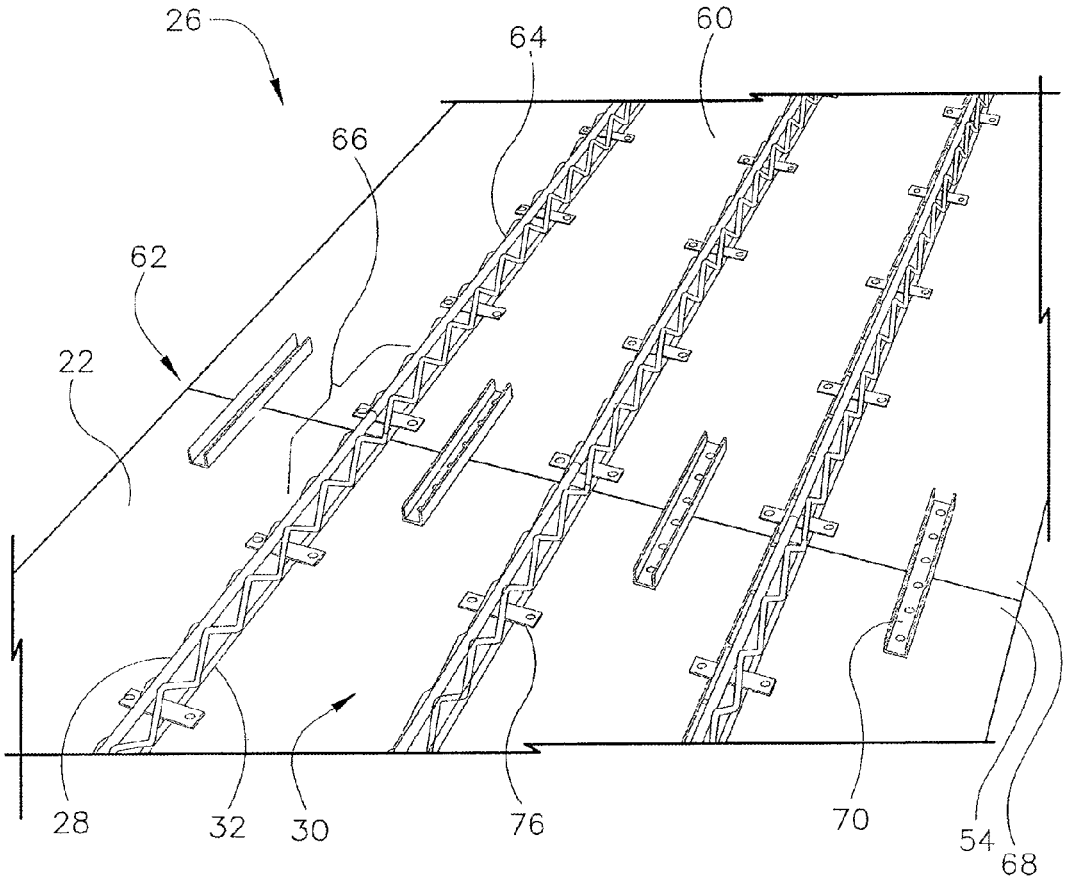
FIG. 2 is a cut away perspective view of a formwork assembly for use with one embodiment of the flooring system.

Turning to FIG. 1, a floor 20 formed by the formwork system and method is illustrated. As can be seen, a form member 22 is provided which supports concrete 24, or a concrete slab, positioned thereon. It is noted that while concrete 24 is specifically disclosed herein, concrete, cement, and other substances may be supported by the formwork system or assembly. In one embodiment, concrete 24 is placed on the formwork assembly 26 in a fluid state, and engulfs the one or more reinforcement beams 28 that are placed upon the form member 22. In a preferred embodiment, the concrete 24 comprises a structurally reinforced concrete. The structurally reinforced concrete may include steel fibers, and/or may include a web or mesh of reinforcement rods, including but not limited to steel rebar rods, to increase the overall strength of the assembly. Furthermore, the piping and conduits for potable water, waste water, energy, and/or other electromechanical components may be embedded in the concrete floor slab. These additional components would be added or attached prior to the placement of concrete on the form member. Alternatively, as shown in FIG. 16, concrete 24 may engulf or cover a substantial portion of the reinforcement beam(s) 28 that extends above the contact surface 30 of the form member 22 (FIG. 2). For instance, a portion of the reinforcement beam 28 may remain within one or more grooves (to be discussed in further detail herein) in the contact surface 30 of the form member 22 and may not be surrounded by the concrete mixture. Furthermore, a chemical welding 32, as will be discussed in further detail below, may be used to attach the reinforcement beam 28 inside the groove(s), to the groove, forming a monolithic structure between the form member 22 and the reinforcement beam 28.

Figure 3:
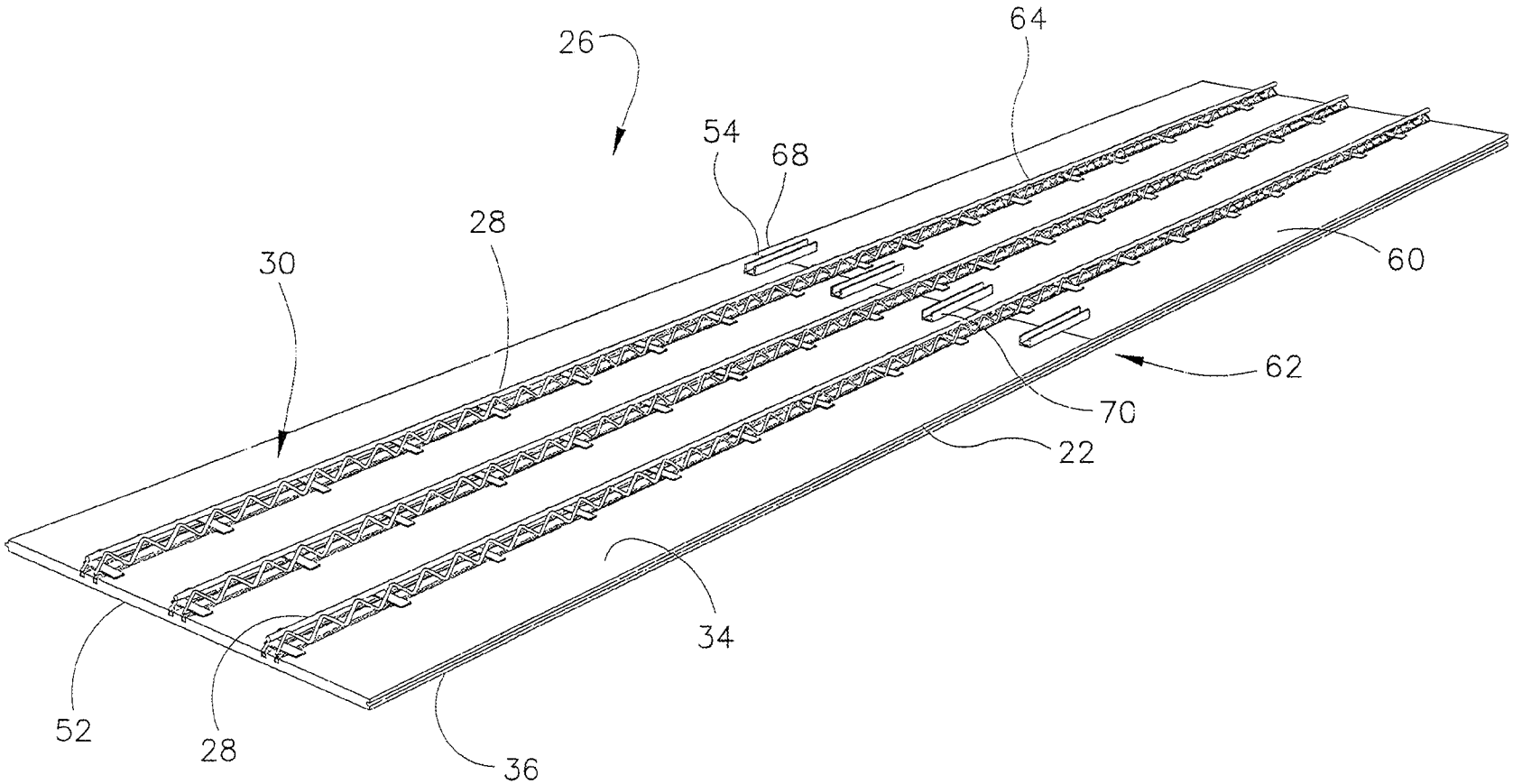
FIG. 3 is a perspective view of a formwork assembly in an embodiment of the flooring system having form members connected end-to-end.
Figure 4:
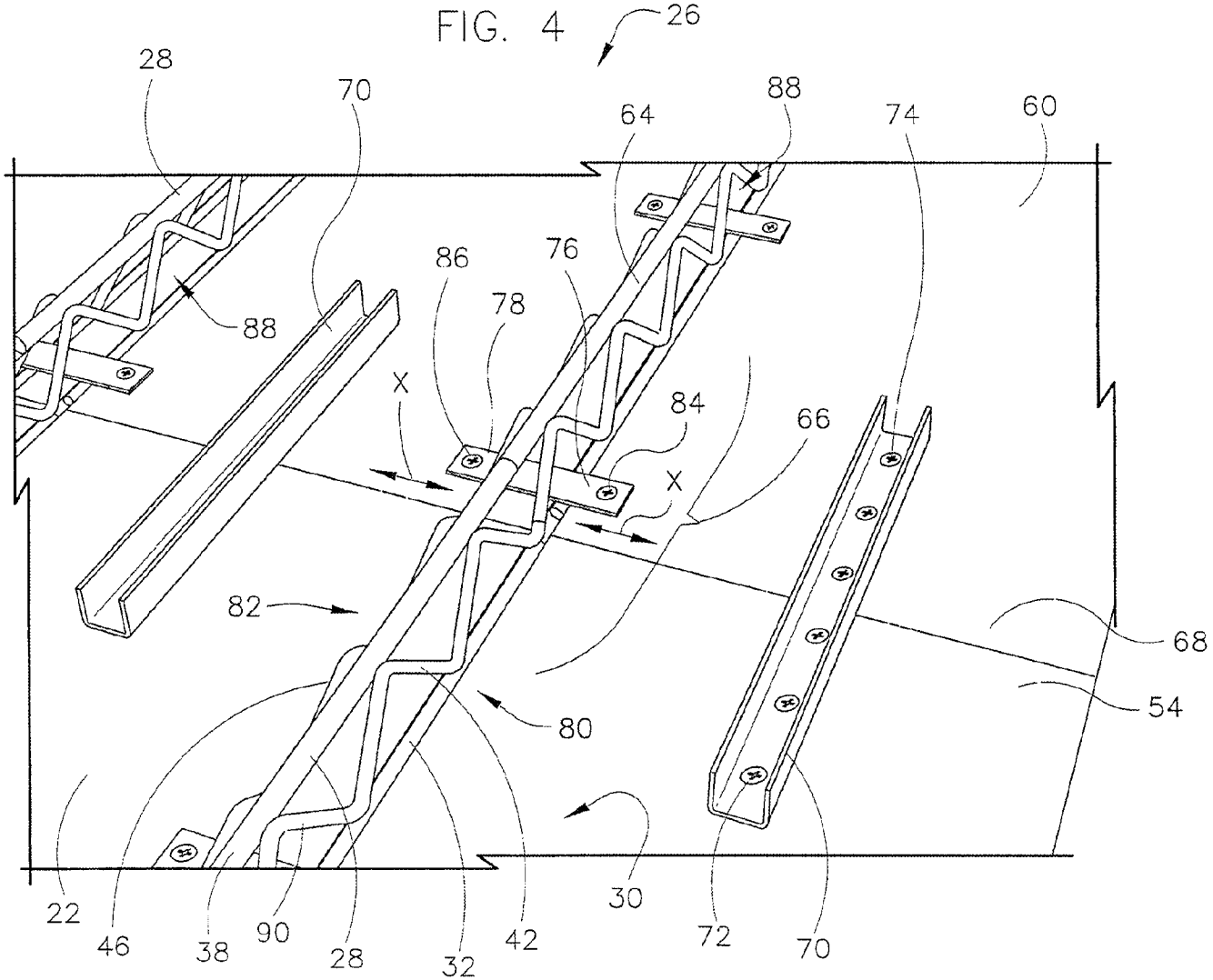
FIG. 4 is a cut away perspective view of a formwork assembly shown in FIG. 3.
Figure 5:
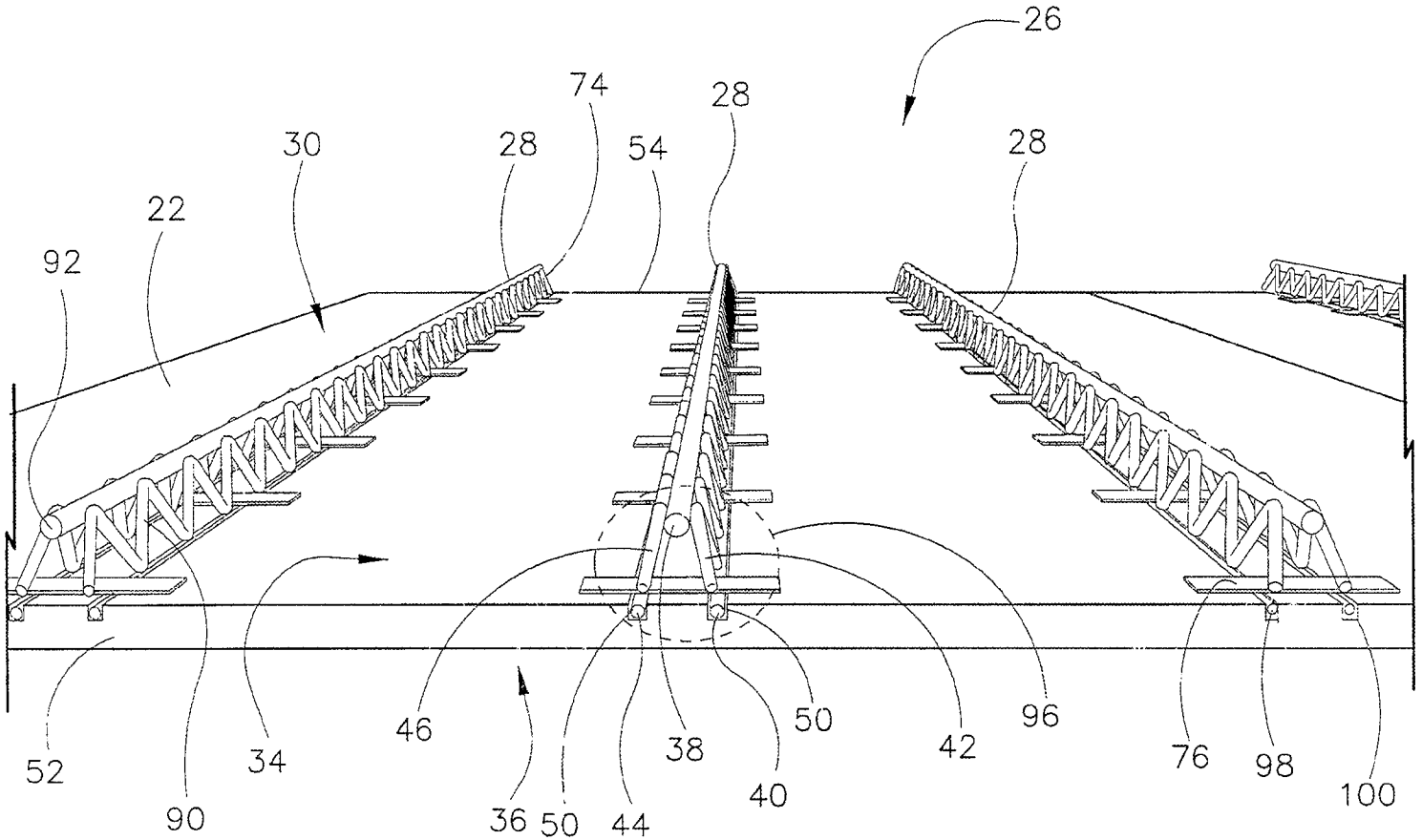
FIG. 5 is an elevated perspective view from one end of the formwork assembly in an embodiment of the flooring system.

As shown in FIGS. 3-5, the floor 20 may comprise a form member 22 having a first side 34 and a second side 36. The reinforcement member 28 is provided having a first longitudinal member 38 spaced a distance from the first side 34 of the form member 22 and a second longitudinal member 40 connected to the first longitudinal member 38 by a first diagonal support member 42, the second longitudinal member 40 is also in contact with the form member 22. A third longitudinal member 44 may be provided in contact with the first longitudinal member 38 by a second diagonal support member 46, and in contact with the form member 22. As described above, concrete 24 is placed in contact with the form member 22 and reinforcement member 28, which when hardened, forms the floor 20.

Referring to FIGS. 2-7, an embodiment of the formwork assembly 26 of the flooring system is illustrated. In a preferred embodiment, the floor 20 and, more specifically, the formwork assembly 26 comprises a form member 22 having a contact surface 30. The reinforcement beam 28 is attached to the contact surface 30 of the form member 22, forming the formwork assembly 26. In a preferred embodiment, the contact surface 30 of the form member 22 comprises a first groove 48 for receiving a portion 40 of the reinforcement beam 28 and a second groove 50 for receiving a portion 44 of the reinforcement beam 28 (See FIG. 5). The groove(s) 48, 50 may longitudinally extend from a first end 52 of the form member 22 to a second end 54 of the form member 22. The reinforcement beam 28 is placed in the groove(s) 48 and/or 50, and extends from the first end 52 of the form member 22 to the second end 54 of the form member 22. Preferably, the reinforcement beam 28 comprises a geometrical configuration which adds rigidity to the formwork assembly 26 and resultant floor 20 or ceiling. A plurality of reinforcement beams 28 may be attached to a form member 22, or a plurality of reinforcement beams 28 may be attached to a plurality of form members 22. Likewise, the formwork assembly 26 or system may comprise a plurality of form members 22. In at least one embodiment, the plurality of form members 22 may be connected by a tongue 56 positioned on an edge of a first form member 22 mating with a groove 58 positioned on an edge of a second form member 60 (see FIG. 19). The foregoing formwork assembly 26 may be attached or placed in contact with concrete 24, such as a concrete slab, resulting in a floor 20 or ceiling.

In the embodiment shown in FIGS. 2-4, a plurality of form members 22 are operably attached or connected together having a plurality of reinforcement beams 28. In this embodiment, a first form member 22 and a second form member 60 are attached end-to-end 62. As a result, the first reinforcement beam 28 positioned on the first form member 22 and the second reinforcement beam 64 positioned on the second form member 60 may be likewise aligned end-to-end to form a continuous longitudinal support structure 66.

Figure 6:
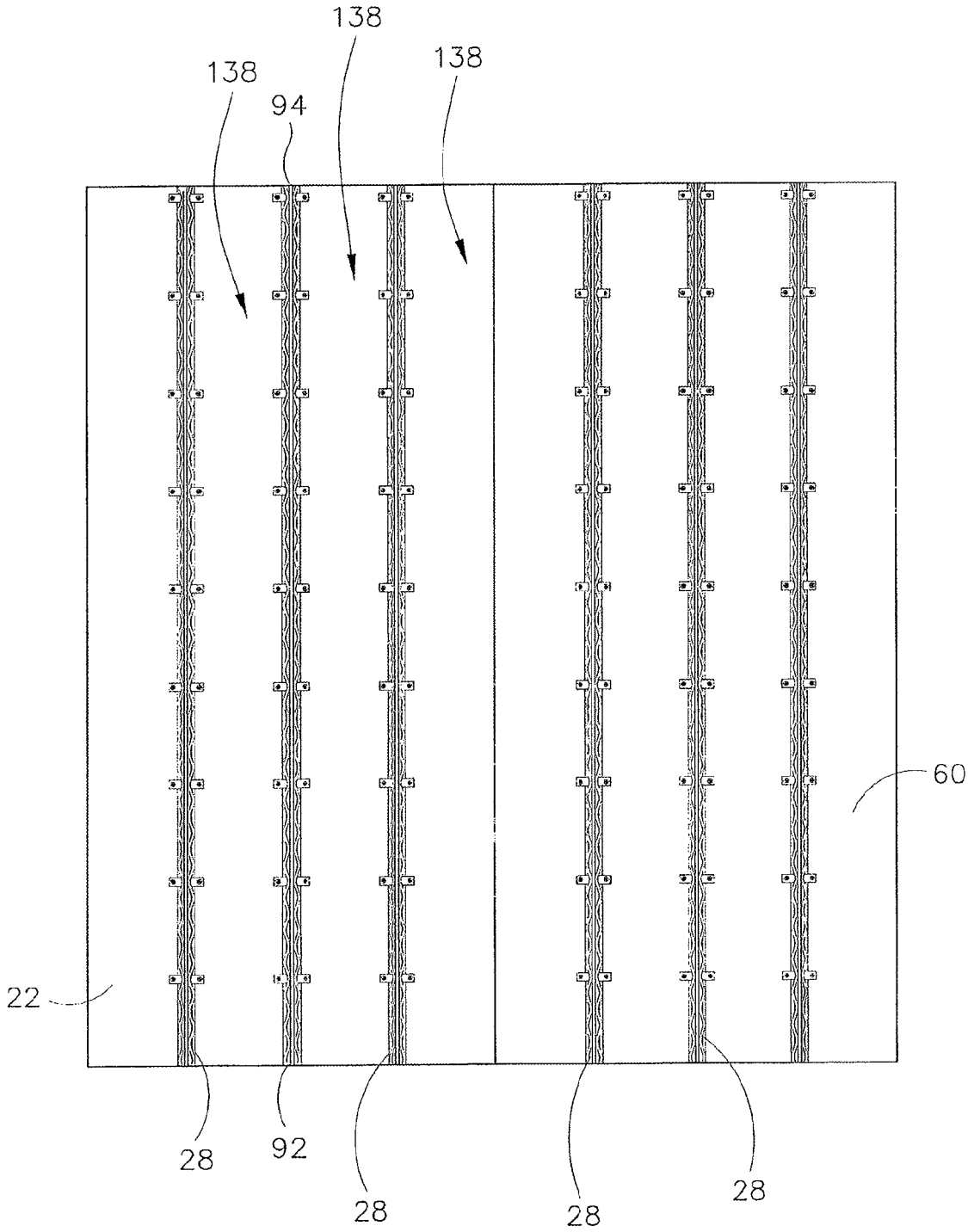
FIG. 6 is a top plan view of a formwork assembly in an embodiment of the formwork system having form members adjacently positioned.
Figure 7:
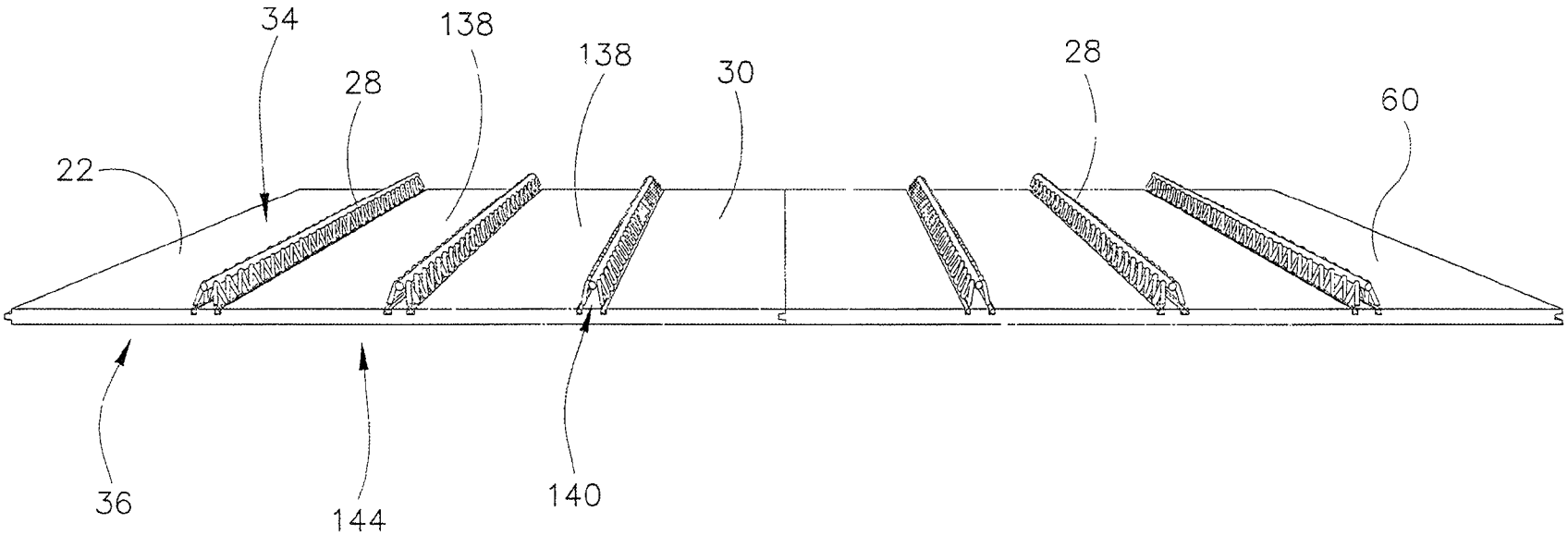
FIG. 7 is an elevated perspective view of the formwork assembly shown in FIG. 6, illustrating an end of the formwork assembly.

FIGS. 5-7 illustrate an alternative embodiment of the formwork assembly 26, having a plurality of adjacently attached form members 22. Namely, the first form member 22 is adjacently attached to the second form member 60. These form members 22 may be attached and connected by any means known in the art or which have been described herein. As can be seen, the adjacent attachment of form members 22, 60 results in a plurality of parallel aligned reinforcement beams 28. These beams are spaced apart. Moreover, when a plurality of reinforcement beams 28 are provided, a plurality of grooves 48, 50 may be provided for receiving the reinforcement beams 28. For example, a first reinforcement beam 28 may be seated within a first groove 48 and a second groove 50. A second reinforcement beam 64 may be seated within a third groove 98 and a fourth groove 100, and so forth.

As will be discussed in greater detail in reference to FIGS. 21-23, FIG. 4 shows the first form 22 or panel and the second form 60 or panel may be connected using a tongue 56 and groove 58 arrangement, in which a tongue 56 is provided on the first form member 22 and the groove 58 is positioned on the second foam member 60 so that the first and second form members 22, 60 mate and interlock at the tongue and groove to form a close connection between these two structures. Alternatively, no such tongue and groove arrangement is needed, permitting the end 54 of the first form member 22 to abut the end 68 of the second form member 60. One or more fasteners 70 may be used to connect the first form member 22 and the second form member 60. A fastener 70 commonly used in the art for connecting adjacent form members 22, 60 together may be acceptable for the purposes provided. In a preferred embodiment, the fastener 70 comprises a longitudinal bracket or element having one or more openings 72 therein for receiving a threaded fastening device 74 or a plurality of threaded fastening devices, such as screws. The threaded fastening device(s) 74 is inserted into the one or more openings 72 in the bracket 70 and threaded into the form member(s) 22 and/or 60, thereby securing the form members 22, 60 together in the designated locations. While "screws" and "brackets" are specifically described, other means of attachment of adjacent form members known in the art would be acceptable for the purposes provided, including, but not limited to, screws, nut and bolt, friction fit, snap-fit, tongue and groove, rivet, adhesive, nails, and combinations thereof.

As disclosed herein, the form members 22 preferably comprise fibercement. However, form member(s) may comprise any substantially planar structure or panel, or any structure suitable for the purpose of forming a floor, ceiling or other structure, and may be comprised of any material suitable to the manufacturer, the user, or the specific requirements of the building site, including, but not limited to fiber board, wall board, composites, concrete, cement, masonite, fiber cement, wood, plastic, polyurethane, and/or combinations thereof. For example, a form member comprising an organic fiber cement asbestos-free board having no crystalline silica added, which is based upon a mixture of cellulose fibers, cement and calcium carbonate, with or without ARGF and with or without impregnator coating may be used for the assembly described herein. Moreover, the planar structure or form member may be of any size and thickness preferred by the manufacturer or the user.

As shown in FIG. 4, in the formwork assembly 26 of a preferred embodiment, the reinforcement beam 28 is attached to the form member 22. When in contact, the second longitudinal member 40 of the reinforcement beam is placed in contact with the form member 22. Preferably, the second longitudinal member 40 is positioned in a first groove 48 of the form member 22. Similarly, the third longitudinal member 44 is placed in contact with the form member 22. The third longitudinal member 44 is preferably positioned in a second groove 50 of the form member 22. The reinforcement beam 28 may be further connected or attached to the form member 22 by one or more attachment members 76, or alternatively, by adhesive, by welding, by friction fit, or by other means available in the art. Additionally, a cover member 32 for covering at least one longitudinal member 40, 44 or a portion of a longitudinal member may be provided.

Referring to FIGS. 2-9, the attachment of the reinforcement beam 28 or beams to the form members 22 is illustrated. As can be seen, one or more reinforcement beams 28 and/or 64 may be attached to the form member 22 and/or 60. While a specific arrangement is disclosed, in a preferred embodiment, the number and arrangement of reinforcement beams 28, 64 and/or form members 22, 60 may be determined based upon user preferences, manufacturer preferences, structural load bearing requirements, building codes, and other factors. Preferably, when a plurality of reinforcement beams 28 are positioned on a single form member 22, the reinforcement beams 28 are arranged in a spaced apart parallel orientation. Moreover, whether a single reinforcement beam 28 or a plurality of reinforcement beams 28 are used, the reinforcement beam(s) 28 extends longitudinally from a first end 52 of the form member 22 to a second end 54 of the form member 22.

The attachment of the reinforcement beam 28 to the form member 22 may be by means commonly available in the art. In the preferred embodiment, the reinforcement member 28 is positioned, or at least partially positioned in one or more grooves 48, 50 on the form member 22. The reinforcement beam 28, in the preferred embodiment, is attached to the grooves 48, 50 of the form member 22 by adhesive. Namely, adhesive is applied between the second longitudinal member 40 and the form member 22 within groove 48, and adhesive is applied between the third longitudinal member 44 and the form member 22 within groove 50.

While adhesive, alone, is sufficient to retain the reinforcement beam in position, the reinforcement member 28 may be further attached to the form member 22, or alternatively attached to the form member 22 by an attachment member 76 or plurality of attachment members. The attachment member 76 may comprise a plate 78 extending laterally from a first side 80 to a second side 82 of the reinforcement beam 28, or more specifically extending a distance X beyond a first side 80 and a distance X beyond a second side 82 of the reinforcement beam 28. These distances may be equivalent or differ in dimension. Alternatively, the attachment member 76 may comprise a clip for securing the reinforcement beam 28 in place on the form member 22. In a preferred embodiment, the clip or plate 78 comprises a rectangular plate, and may have one or more openings 84 therein for receiving a fastener 86, such as a threaded screw, which may inserted into the opening (s) 84 and threaded into the form member 22, thereby locking the plate 78, and the reinforcement beam 28, in its position. Preferably, a plurality of attachment members 76 are used and spaced apart along the length of the reinforcement beam 28. The attachment members 76 are further positioned in triangular openings 88 formed in the web of triangular struts 90 of the reinforcement beam 28. While a specific attachment member 76 is disclosed herein, other means of attachment of the reinforcement beam 28 to the faun member 22 are contemplated, including but not limited to, adhesive, molding, chemical welding, friction fit, nut and bolt fastener, tongue and groove, rivets, and other means commonly available in the art. Likewise, the reinforcement beam 28 may be attached directly to the foam member by inserting a fastener directly (not shown) into one or more of the longitudinal members 40, 44 of the reinforcement beam 28 and directly into the form member 22. In addition, a cover member 32 may be provided on a portion of the reinforcement beam 28 so as to cover the one or more longitudinal members 40, 44 of the reinforcement beam 28. Additionally, if a cover member 32 is included, the cover is positioned between the attachment member 76 and the second longitudinal member 40 and the third longitudinal member 44. Further, this cover member 32 may extend longitudinally from the first end 92 to the second end 94 of the reinforcement beam 28 and/or the form member 22.

Figure 19:
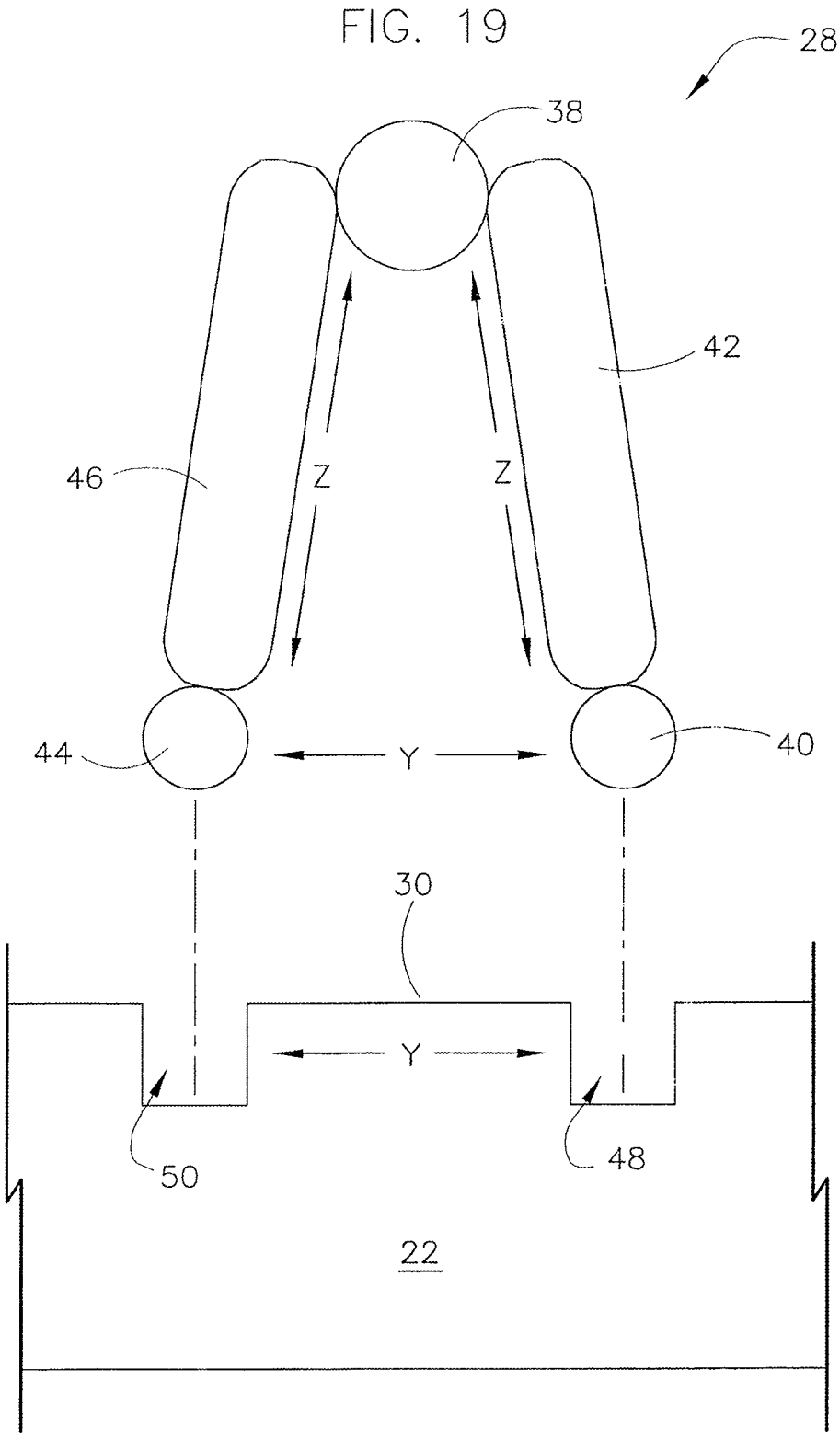
FIG. 19 is a cut away exploded view showing the reinforcement beam and form member in an embodiment of the formwork assembly.
Figure 20:
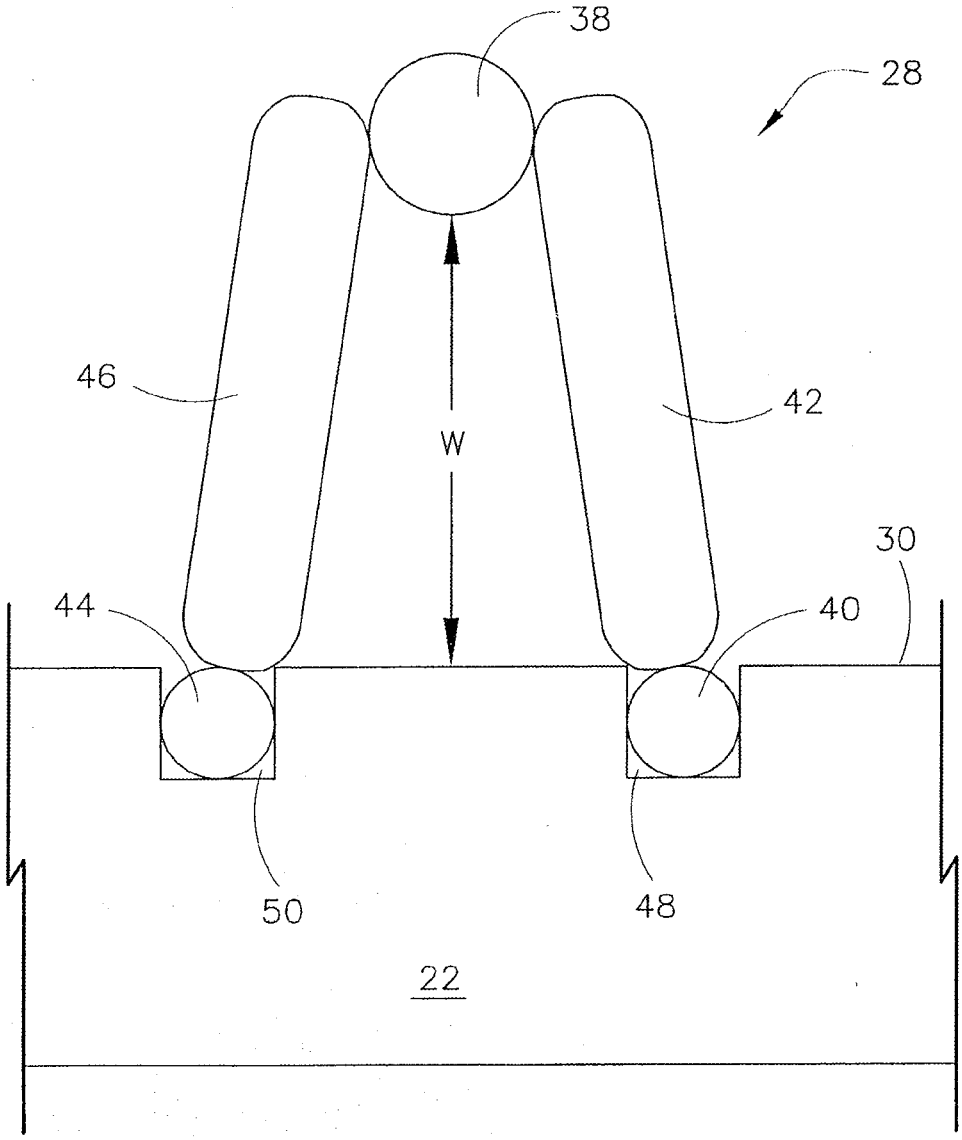
FIG. 20 is a cut away side elevational view showing the combined reinforcement beam and form member in an embodiment of the formwork assembly.

As best seen in FIGS. 5, 8, and 10-13, the reinforcement beam 28 of the floor formwork system comprises a first longitudinal member 38, a second longitudinal member 40, and third longitudinal member 44. One or more, and preferably, a plurality of first diagonal support members 42 extend from the first longitudinal member 38 to the second longitudinal member 40. One or more, and preferably, a plurality of second diagonal support members 46 extend from the first longitudinal member 38 to the third longitudinal member 44. A plurality of first diagonal support members 42 (or a plurality of second diagonal support members 46) forms a linear repeating pattern of triangular supports, or a web of triangular struts 90. A plurality of diagonal support members 42 or 46 forms a web of diagonal or triangular struts 90 that extend between the first longitudinal form member 22 and the second longitudinal form member 22 or the first longitudinal member 38 and the third longitudinal member 44. Moreover, the first longitudinal member 38, the second longitudinal member 40 and the third longitudinal member 44, which are each respectively spaced apart, form a triangular support arrangement 96. When in use with the formwork assembly 26, the first longitudinal member 38 is spaced a distance W from the attached form 22 (see FIG. 20). Second and third longitudinal members 40, 44 are preferably embedded within the Run member 22 in one or more grooves 48, 50 positioned in the form member 22. The second longitudinal member 40 and third longitudinal member 44 are spaced a distance Y apart and are spaced a distance Z from the first longitudinal member 38 as a result of the one or more diagonal support members 42 or 46 (see FIG. 19). Referring to FIGS. 19 and 20, as a result of the foregoing arrangement, when the reinforcement beam 28 is placed in contact with the form member 22, the first longitudinal member 38 of the reinforcement beam 28 is spaced a distance W from the form member 22. The first longitudinal member 38 is also spaced a distance Z from the second longitudinal member 40 and the third longitudinal member 44 of the reinforcement beam 28. Finally, the second longitudinal member 40 is spaced a distance Y from the third longitudinal member 44. Thus, the first longitudinal member 38, second longitudinal member 40, and third longitudinal member 44 form a triangular support or reinforcement structure 96 for the formwork assembly 26.

Figure 8:
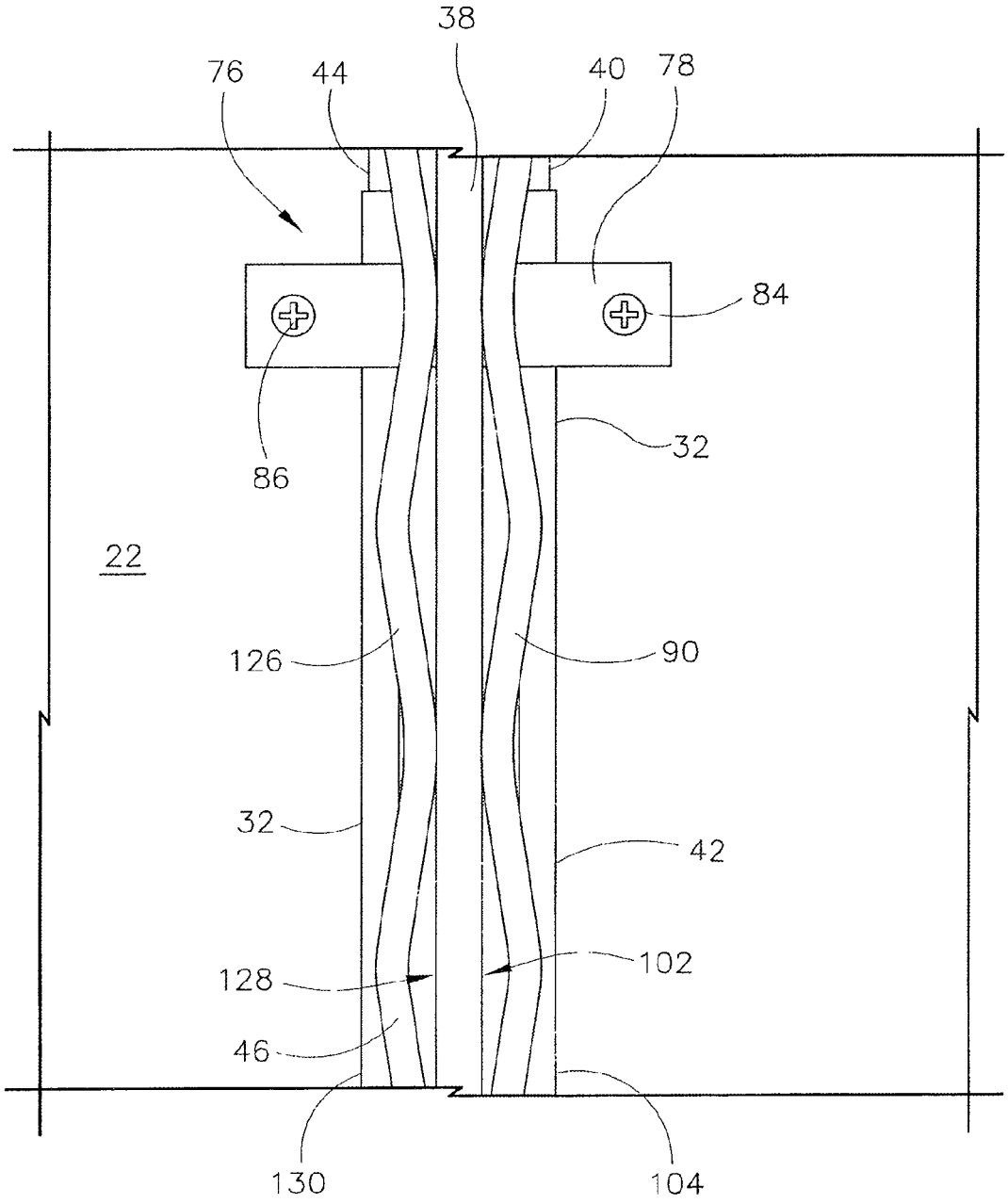
FIG. 8 is a cut away top plan view of a reinforcement beam positioned on a form member in an embodiment of the formwork assembly.
Figure 9:
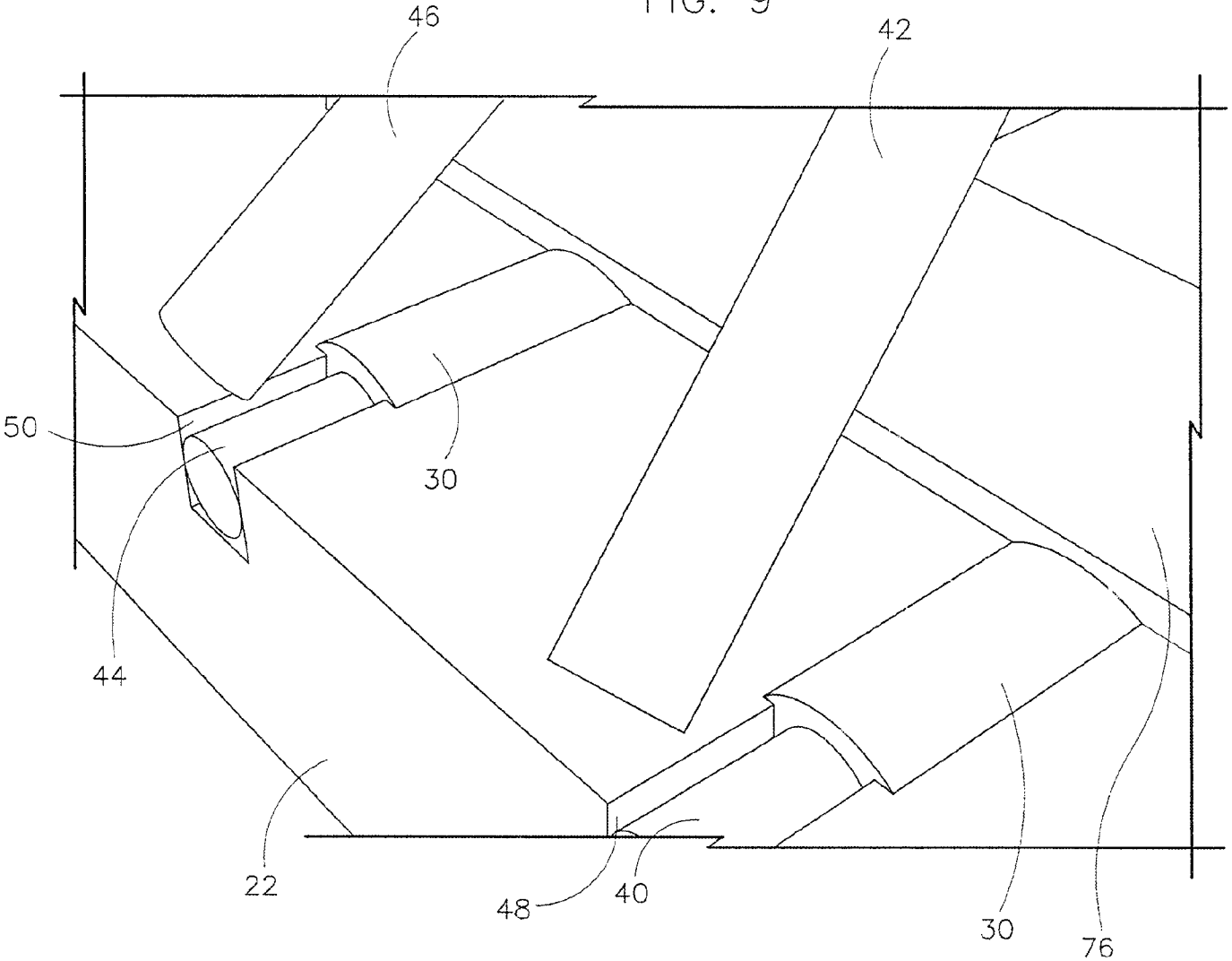
FIG. 9 is a cut away perspective view of an end of a reinforcement beam as attached to a form member in an embodiment of the formwork assembly.
Figure 10:
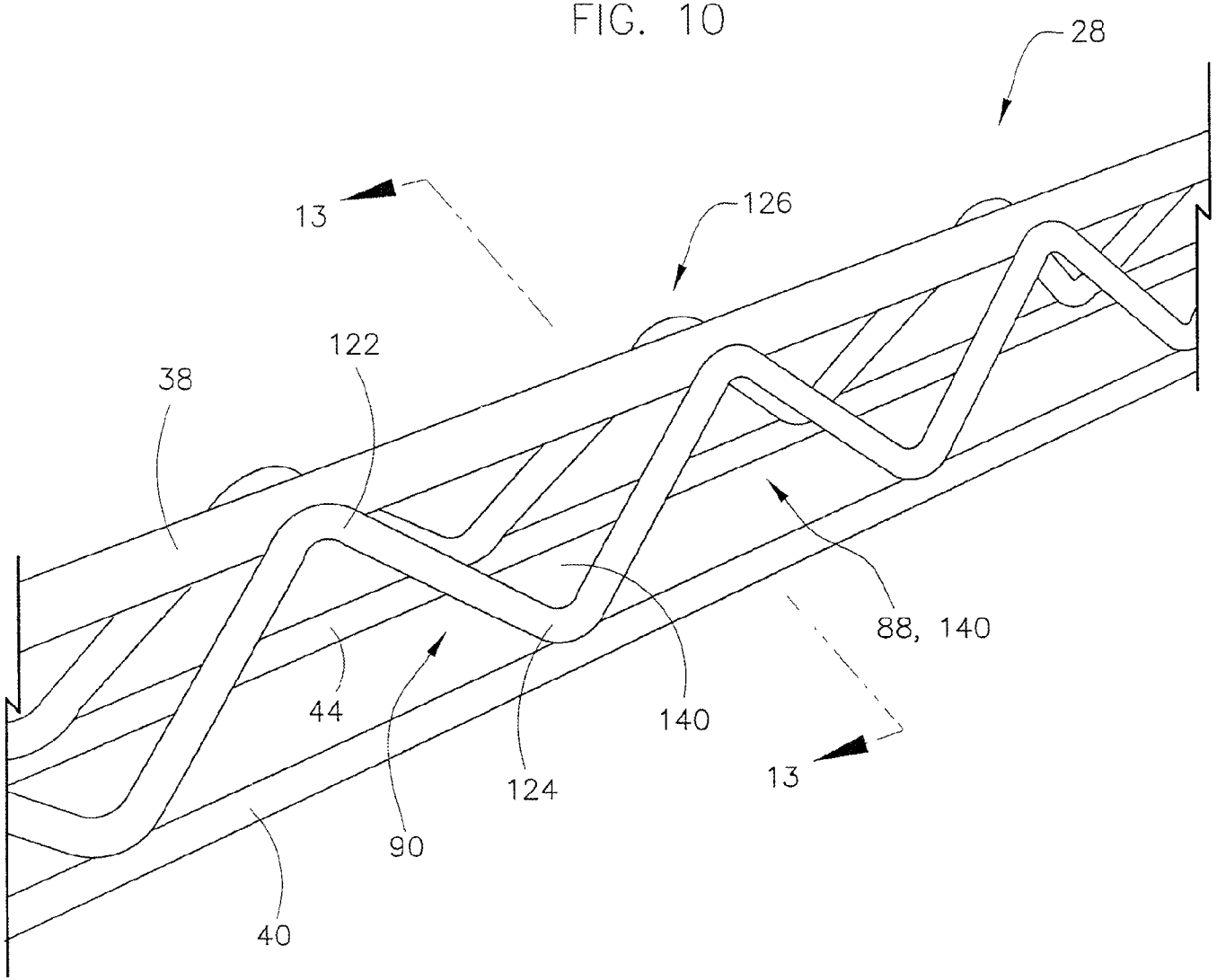
FIG. 10 is a cut away perspective view of a reinforcement beam in an embodiment of the formwork system.
Figure 11:
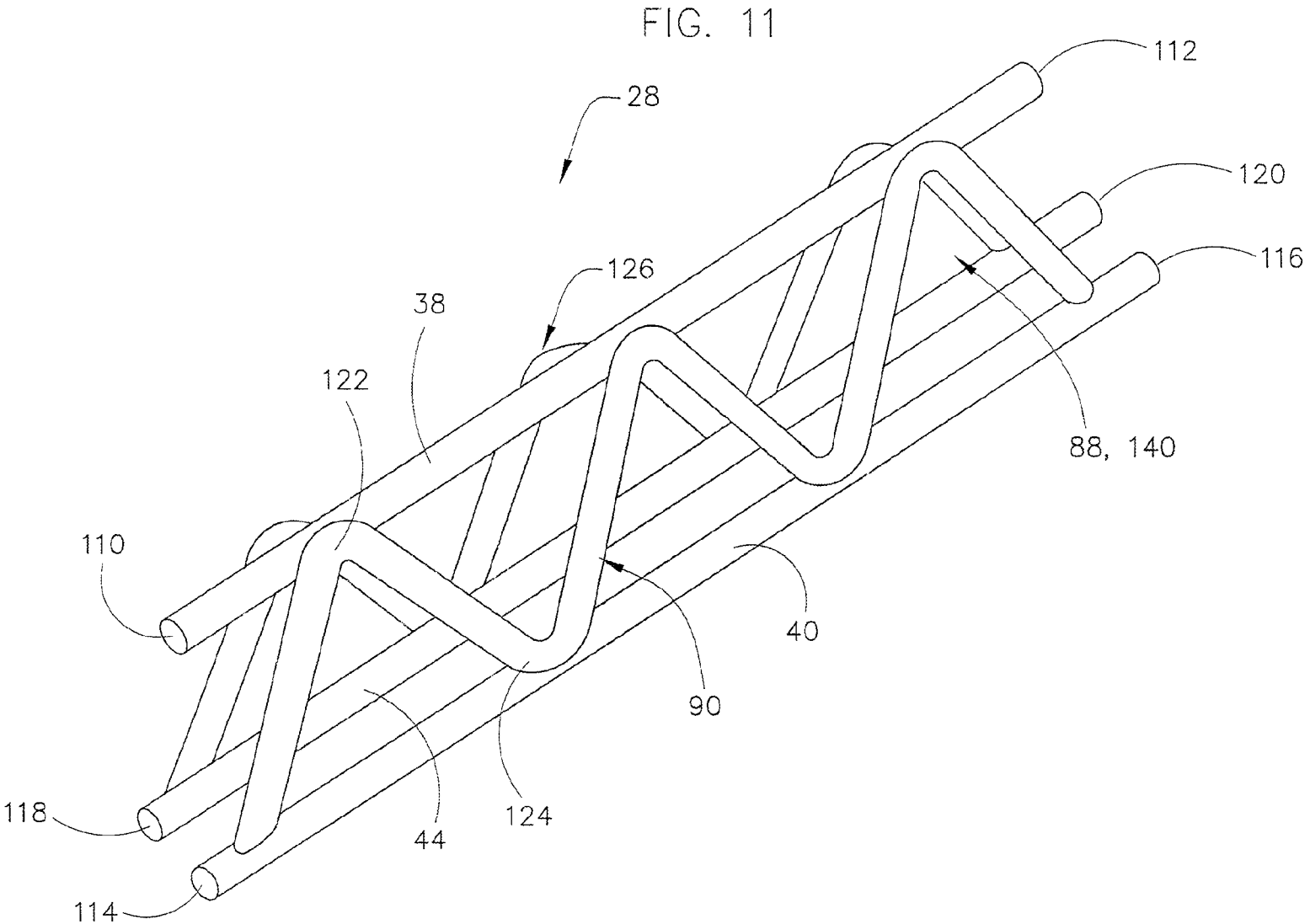
FIG. 11 is a perspective view of a reinforcement beam in an embodiment of the formwork system.
Figure 12:
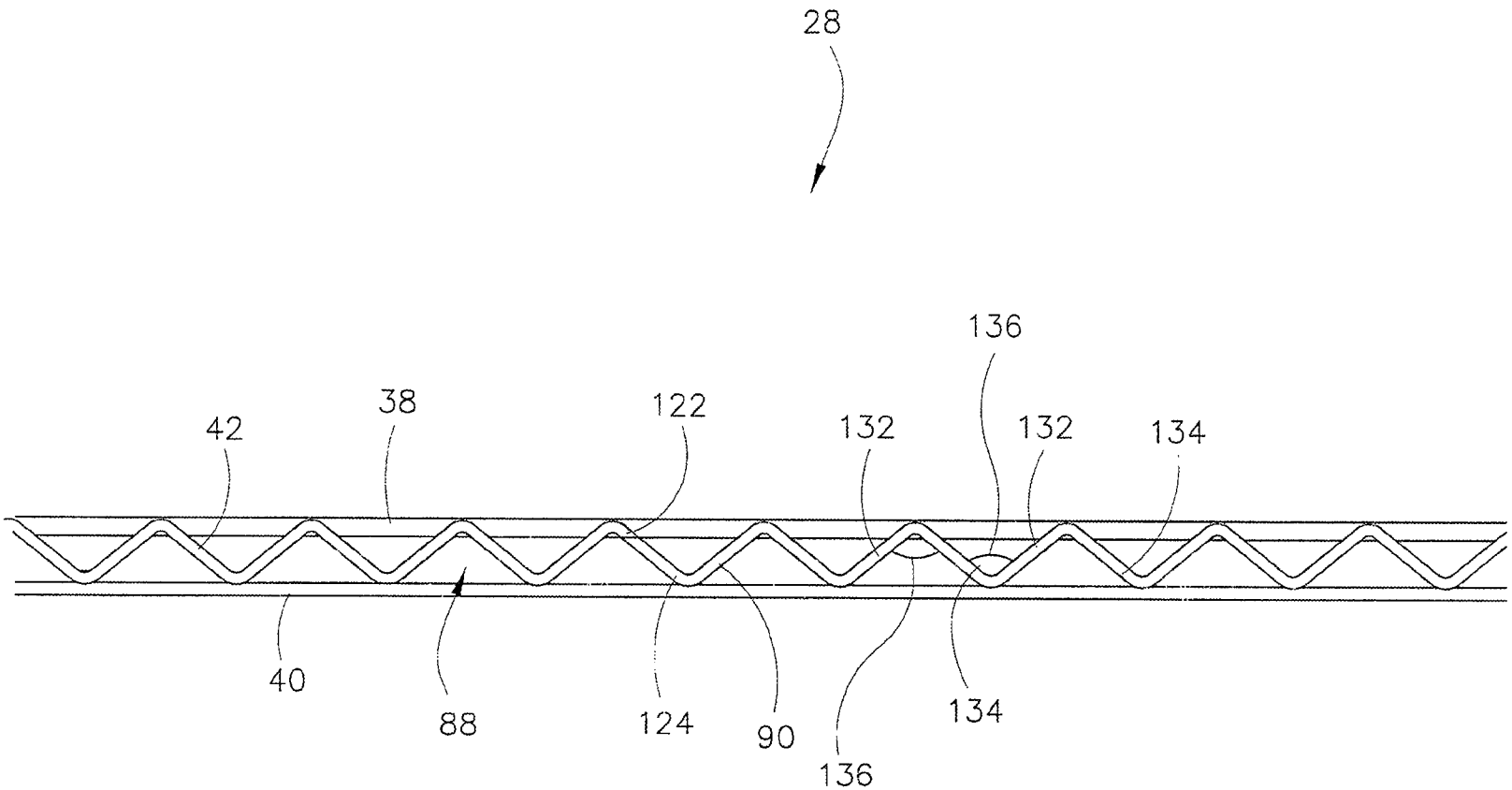
FIG. 12 is a cut away side elevational view of a reinforcement beam in an embodiment of the formwork system.
Figure 13:
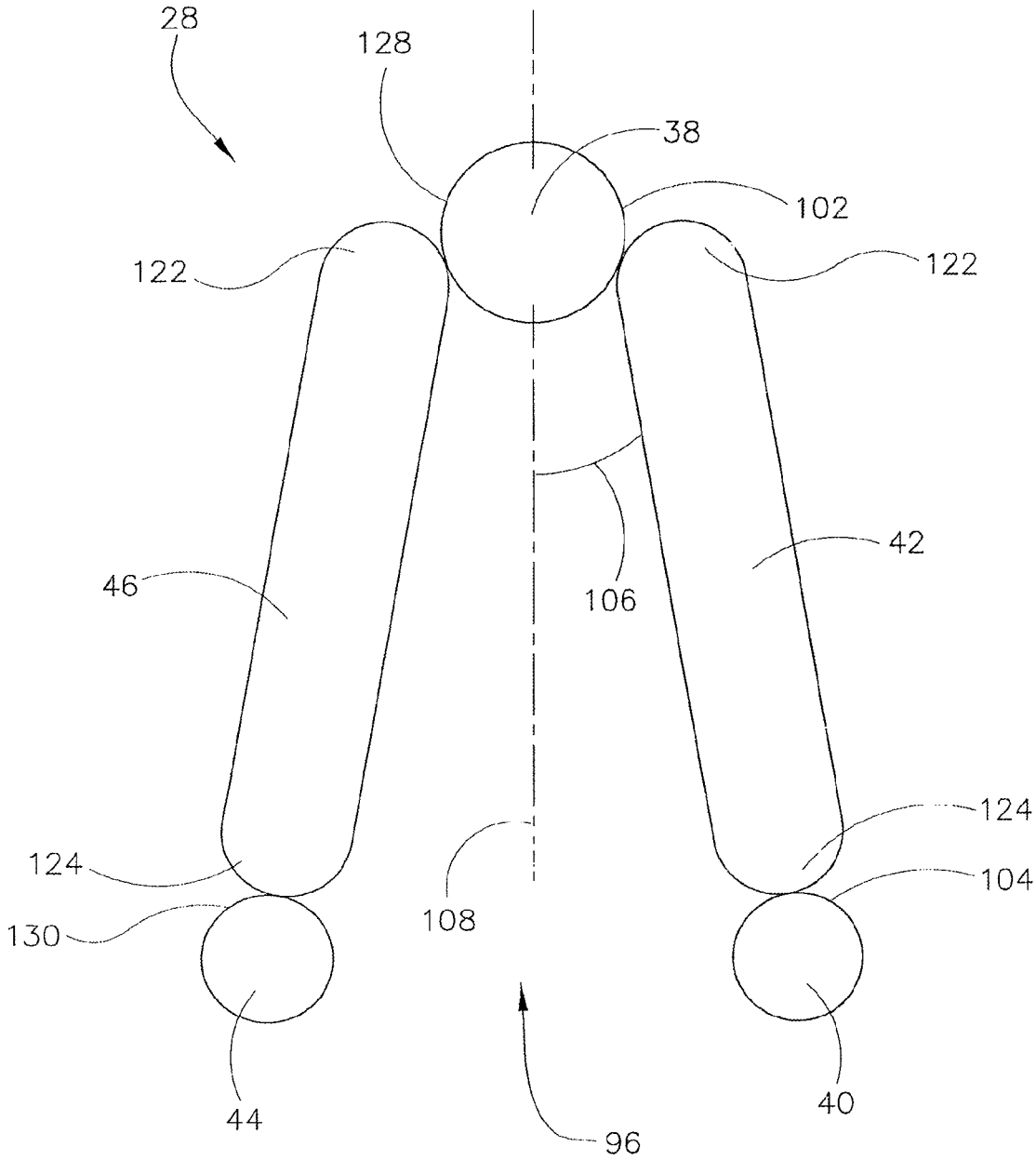
FIG. 13 is a cross-sectional view of an embodiment of the reinforcement beam taken along line 13-13 of FIG. 10.

Additionally, as can be seen from FIGS. 8 and 9, the attachment member 76 or plate 78 extends laterally through the reinforcement beam 28 or member and, thus, between the first longitudinal member 38 and the second and third longitudinal members 40, 44. The laterally extending attachment member 76 is further attached to the form member 22 as described herein. In addition, the first longitudinal member 38 is approximately centered between the position of the second longitudinal member 40 and the position of the third longitudinal member 44. Moreover, the first diagonal support member 42 extends from a first side 102 of the first longitudinal member 38 to a top portion 104 of the second longitudinal member 40. The second diagonal support member 46 extends from a second side 128 of the first longitudinal member 38 to the top portion 130 of the third longitudinal member 44. Moreover, based upon the spacing Y & Z between the longitudinal members (shown in FIG. 19), the diagonal support members 42 are positioned at an angle 106 from the vertical plane 108 extending from the form member 22 through the first longitudinal member 38 (see FIG. 13). The angle 106 may vary depending upon the Y, W, and Z dimensions. In addition, as can be seen in FIG. 8, the attachment member 76 is inserted within the reinforcement beam 28, so as to be positioned over a portion of the second longitudinal member 40 and a portion of the third longitudinal member 44, but below the first longitudinal member 38. The second longitudinal member 40 and the third longitudinal member 44 may be seated, respectively, within first groove 48 and second groove 50 in the form member 22. Additionally, the attachment member 76 may be attached by threaded fasteners 86 as illustrated in FIG. 8.

The reinforcement beam 28 disclosed herein, preferably, comprises a metal, such as steel, and/or other metals or combinations thereof having sufficient rigidity to support a load of a desired weight. However, plastics and other composites and/or materials meeting the desired characteristics may also be used for the reinforcement beam 28 herein, or portions thereof. The reinforcement beam 28 and/or components thereof may be of any size and thickness preferred by the manufacturer or the user. Likewise, other structures or geometric configurations containing the properties herein would be acceptable for the purposes of the reinforcement beam 28.

Referring to FIGS. 10-13, the reinforcement member 28 is illustrated in further detail. The first longitudinal member 38 of the reinforcement beam 28 comprises a cylindrical or corrugated rod having a first end 110 and a second end 112. The second longitudinal member 40 comprises a cylindrical or corrugated rod having a first end 114 and a second end 116. The third longitudinal member 44, likewise, comprises a cylindrical or corrugated rod having a first end 118 and a second end 120. In a preferred embodiment, the first longitudinal member 38 comprises a diameter greater than the diameter of the second longitudinal member 40 and greater than the diameter of the third longitudinal member 44. Additionally, the second longitudinal member 40 and the third longitudinal member 44 comprise approximately equal diameters. The size or diameter of the rods 38, 40, 44 are defined by the function of the rods. In a preferred embodiment, the rods or longitudinal members 40 and 44 are provided to increase the rigidity of the form member(s) or board(s) 22. Rod 38 is preferably provided to increase the rigidity of the whole formwork assembly. Additionally, once formed with the concrete slab 24, all elements will function and contribute to the structural strength of the floor. While cylindrical rods or beams having certain dimensions are specifically disclosed herein, alternative geometric arrangements, dimensions and structures may be used which may be suitable for the purposes provided.

A first web of triangular struts 90 or diagonal support members 42 is provided on the reinforcement beams having a top portion 122 in contact with the first longitudinal member 38 on a first side 102 of the first longitudinal member 38. The first web of triangular struts 90 or diagonal support members 42 is further provided with a lower portion 124 in contact with the second longitudinal member 40 on a top portion 104 of the second longitudinal member 40. A second web of triangular struts 126 or diagonal support members 46 is also provided. The second web of triangular struts 126 or diagonal support members 46 is provided with a top portion 122 in contact with the first longitudinal member 38 on a second side 128 thereof. The second web of triangular struts 126 or diagonal support members 46 is provided with a lower portion 124 in contact with a third longitudinal member 44 on a top portion 130 thereof. The first web of triangular struts 90 and second web of triangular struts 126 are each made up of a plurality of ascending 132 and descending 134 diagonal supports that form a repeating pattern extending substantially from the first longitudinal member 38 to the second longitudinal member 40 or the first longitudinal member 38 to the third longitudinal member 44. As a result, a repeating pattern of opposing triangular forms is created. In a preferred embodiment, the plurality of ascending and descending diagonal supports 132, 134 is formed from a single member, such as a cylindrical rod, which is bent or shaped into the alternating diagonal support structure that makes up the web of triangular struts 90 or 126. In other words, a rod is bent into a repeating pattern of folds each having an angle 136 preferably greater the 90°. While a web of triangular struts 90 or 126, or a plurality of diagonal supports 42 or 46, 132 or 134 are specifically discussed, it is contemplated that a single diagonal support may be provided in contact with the first longitudinal member 38 and the second longitudinal member 40 or the first longitudinal member 38 and the third longitudinal member 44. Likewise, additional geometric shapes are contemplated to be acceptable for the purposes provided, and may be dictated by the structural requirements or preferences of the user or manufacturer. For example, as is shown in FIGS. 14-15 the reinforcement beam 28 may comprise a rectangular beam having a first longitudinal member 37, a second longitudinal member 39, a third longitudinal member 41 and a forth longitudinal member 43. Webs of diagonal supports 45, 47, 49 connect the first longitudinal member 37 to the second longitudinal member 39, the third longitudinal member 41 to the fourth longitudinal member 43, and the second longitudinal member 39 to the third longitudinal member 41. As a result, the rectangular beam 28 combines lateral webs of diagonal supports 45, 47 and a top (or bottom) web of diagonal supports 49. Another example is shown in FIGS. 16-17. As with the previous example, the reinforcement beam 28 may alternatively comprise a rectangular support structure having spaced a part first, second, third, and fourth longitudinal members 37, 39, 41, 43. Attached to the longitudinal members is one or more rectangular reinforcement 51. The longitudinal members 37, 39, 41, 43 are connected to the rectangular reinforcement 51 so that each longitudinal member is preferably positioned proximate to or at a corner of the rectangle as illustrated in the Figures. However, one of skill in the art would understand that other arrangements and positions may be acceptable for the purposes provided.

The web of triangular struts or diagonal supports 45, 47, 49, 90, 126 or rectangular reinforcements 51 are attached to the longitudinal members by welding or adhesive. Alternatively, fastening devices, such as threaded screws, may be used to interconnect these components. As can be seen from FIG. 12, the combined structure of one embodiment of the first longitudinal member 38, second longitudinal member 40 and third longitudinal member 44, which are interconnected by the first web of triangular struts 90 and the second web of triangular struts 126 or diagonal supports, forms essentially a V-shaped structure. Alternative arrangements are also contemplated herein.

The reinforcement beams 28 are spaced upon the form members 22, 60 so as to provide areas or openings 138 through which a flowable substance, such as concrete 24 may pass. Likewise, the reinforcement beam 28 comprises an open web or contains numerous openings 88, 140 as a result of the web of triangular struts 90 or 126, so as provide areas for the passage of a flowable substance. As a result, concrete 24 may substantially surround the reinforcement beam 28, or plurality of beams, as well as any attached structural attachment or reinforcement members, eliminating voids in the formed floor or ceiling and increasing the strength of the resultant structure. Alternatively, the openings 88, 138, 140 in and between the reinforcement beams 28 may comprise spaces for receipt of additional structural support elements or attachments.

Figure 18:
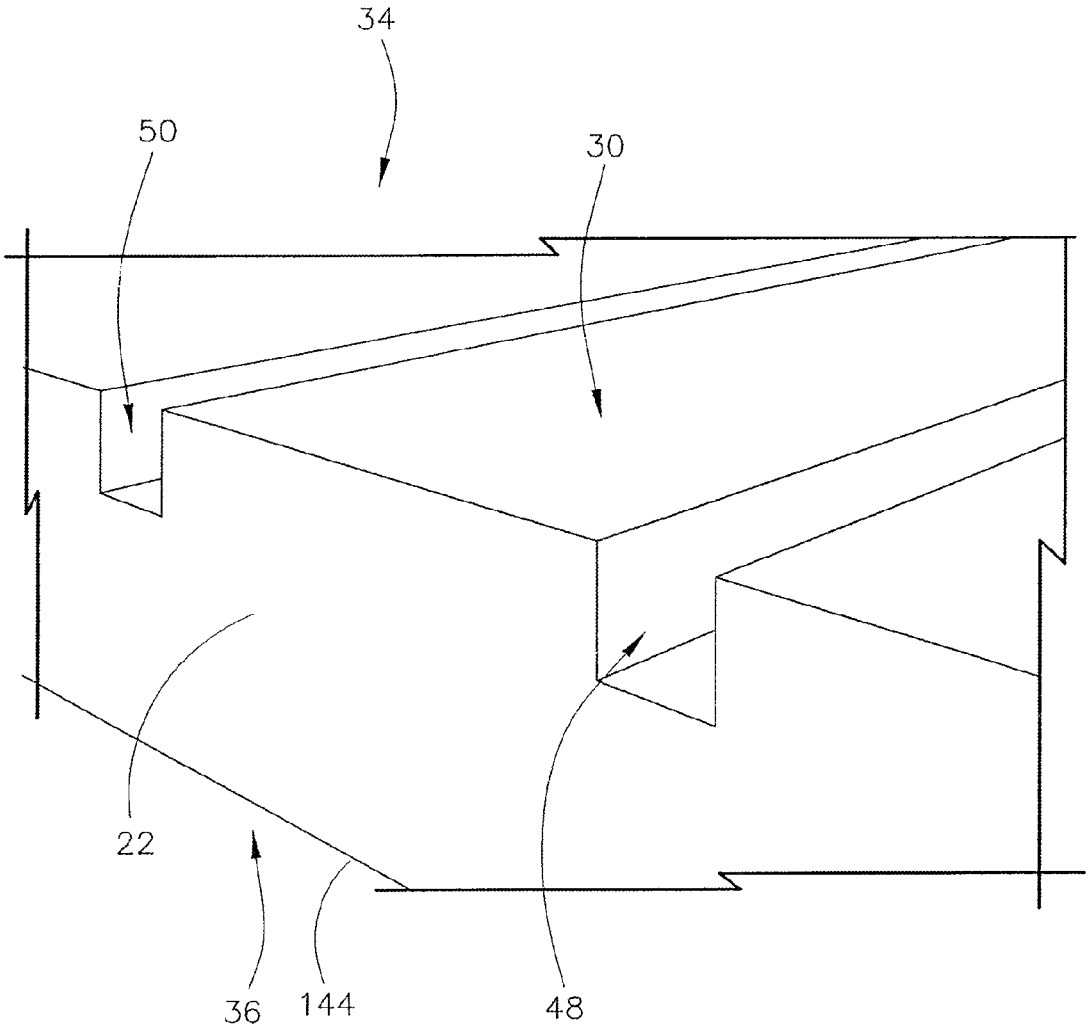
FIG. 18 is a cut away perspective view of a form member in an embodiment of the formwork system.
Figure 18A:
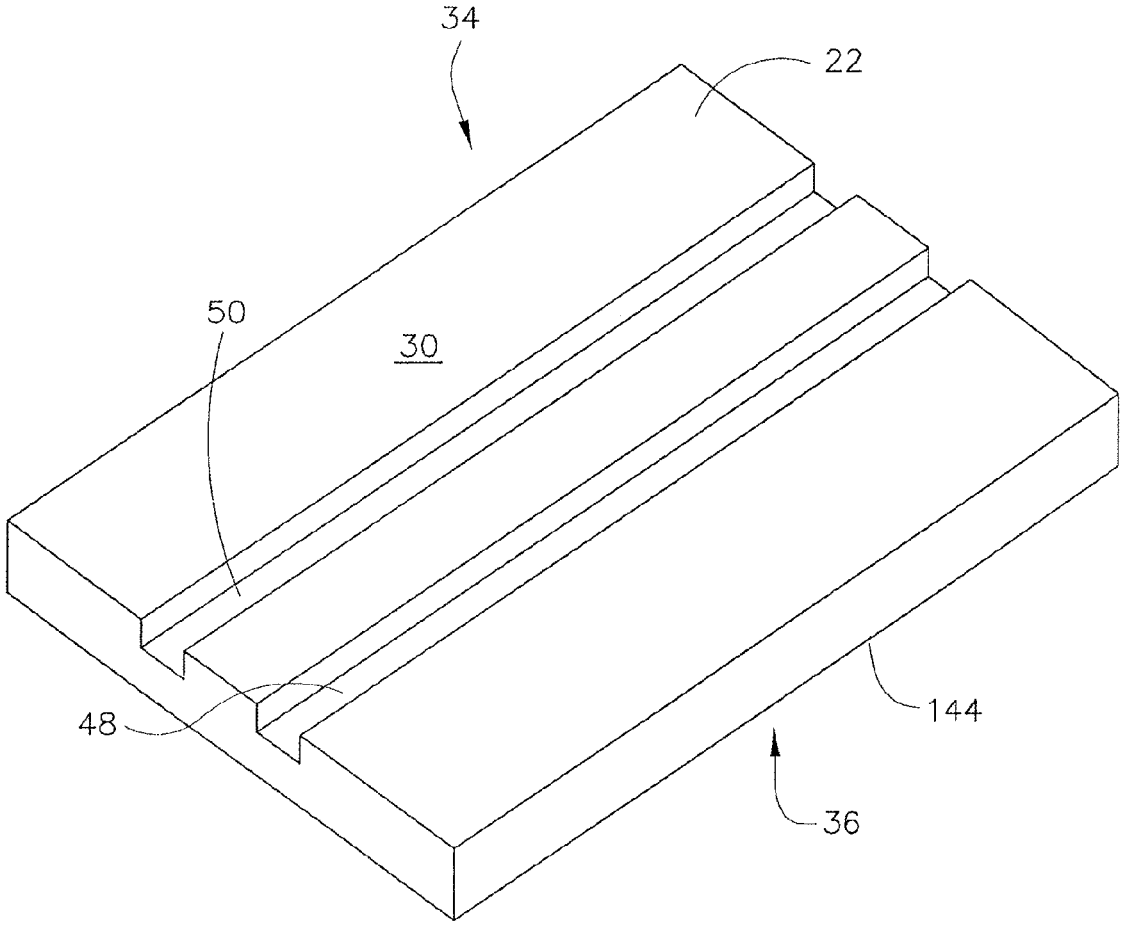
FIG. 18A is a perspective view of the form member shown in FIG. 14.

Referring to FIG. 18, the form member 22 or 60 for use with the flooring system is illustrated. In a preferred embodiment, the form member 22 comprises a first side 34 having a contact surface 30 and a second side 36 opposite the first side. The contact surface 30 has one or more grooves 48, 50 positioned therein. Preferably, at least two grooves are provided in the form member 22. However, as indicated above, more than two grooves may be provided for use with a plurality of reinforcement beams 28. Likewise, one or more grooves may be provided on the surface 144 of the second side 36 of the form member 22 or 60 when desired. The grooves 48, 50 preferably comprise a squared or rectangular notch extending from the surface 30 or 144 of the form inward toward the center of the form. Moreover, the groove(s) 48 and/or 50 extends from a first end 52 of the form member 22 to a second end 54 of the form member 22 (see FIG. 18A). The dimension of the grooves 48, 50, and the spacing Y between the grooves, may be of any dimension suitable for the purposes provided. In the preferred embodiment, as illustrated in FIG. 18, the grooves 48 and 50 are spaced a distance Y which corresponds to the distance between the second longitudinal member 40 and the third longitudinal member 44 of the reinforcement beam 28. Additionally, the depth and the width of the first groove 48 and the second groove 50 are sufficient to receive the second longitudinal member 40 and the third longitudinal member 44, respectively, therein (see FIGS. 19-20). Preferably, the grooves comprise a depth and width corresponding to the diameter of the second longitudinal member 40 and/or third longitudinal member 44 so as to closely contact the longitudinal members and retain same therein. It is contemplated, however, that the grooves 48, 50 may be of smaller dimension, and may comprise means to retain the second longitudinal member 40 and third/or longitudinal member 44 therein, such as a snap or friction fit. Alternatively, the grooves may comprise a larger dimension so as to allow some play or freedom of movement of the reinforcement beam 28 on the form member 22 or alternatively to receive multiple sizes of longitudinal members. Likewise, while a squared groove is specifically disclosed, a groove having other geometric dimensions, such as a groove having rounded edges may also be used for the purposes provided. In the preferred embodiment, the second longitudinal member 40 and the third longitudinal member 44 of the reinforcement beam 28 are received within the first groove 48 and the second groove 50 of the form member 22 so that they do not extend above the contact surface 30 of the form member 22, thereby forming a monolithic attachment of the reinforcement beam 28 and the faun member 22. In other words, the reinforcement beam 28 is "cast" into the form member 22 so as to form one jointless formwork assembly or a single piece of material. As a result of this positioning, the lower portion 122, 124 of the diagonal support(s) is positioned in approximately the same plane as the contact surface 30 of the form member 22 (see FIG. 20).

Figure 21:
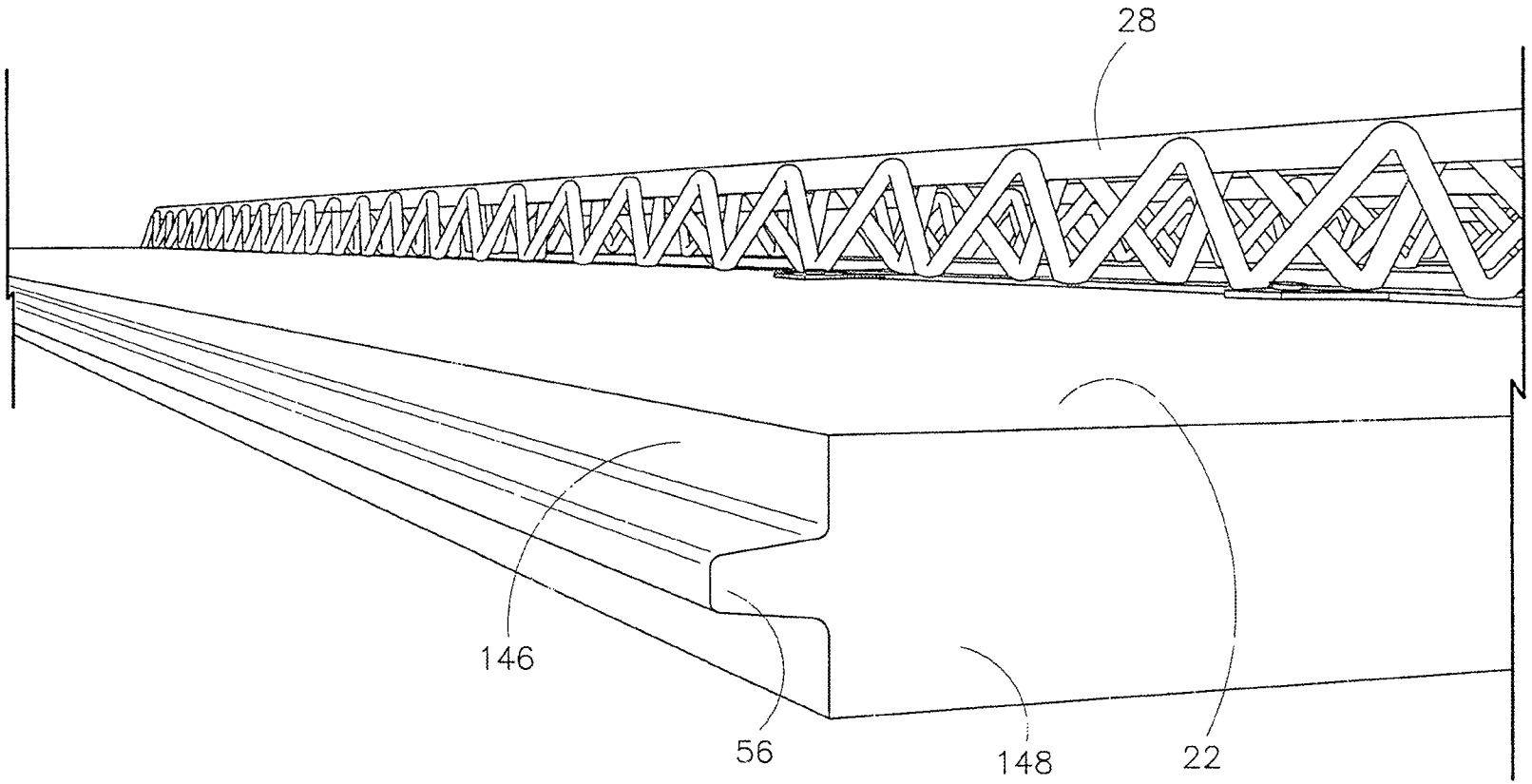
FIG. 21 is a cut away perspective view of a embodiment of the formwork assembly having a tongue on an edge of the form member.
Figure 22:
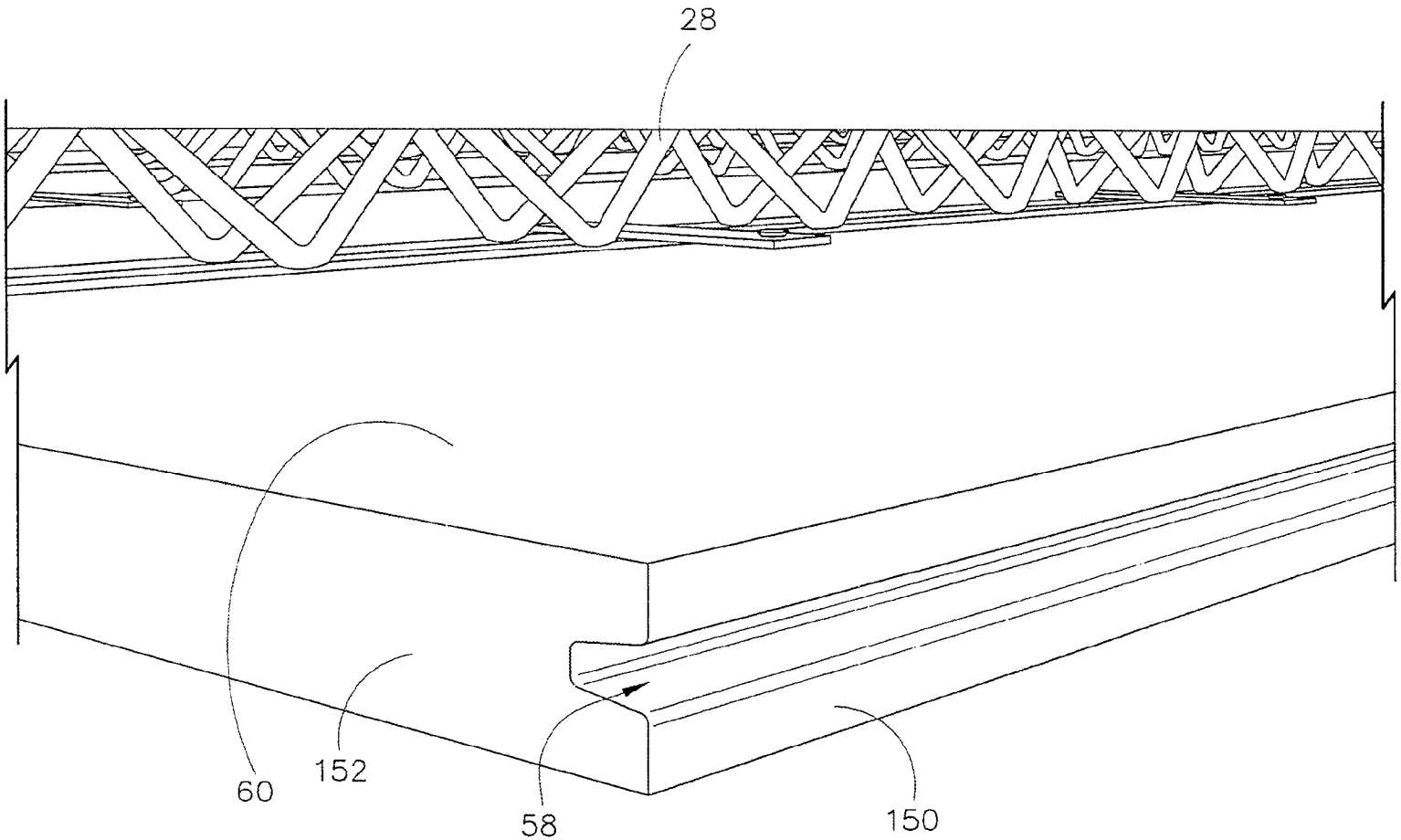
FIG. 22 is a cut away perspective view of an embodiment of the formwork assembly having a groove on an edge of a form member.
Figure 23:
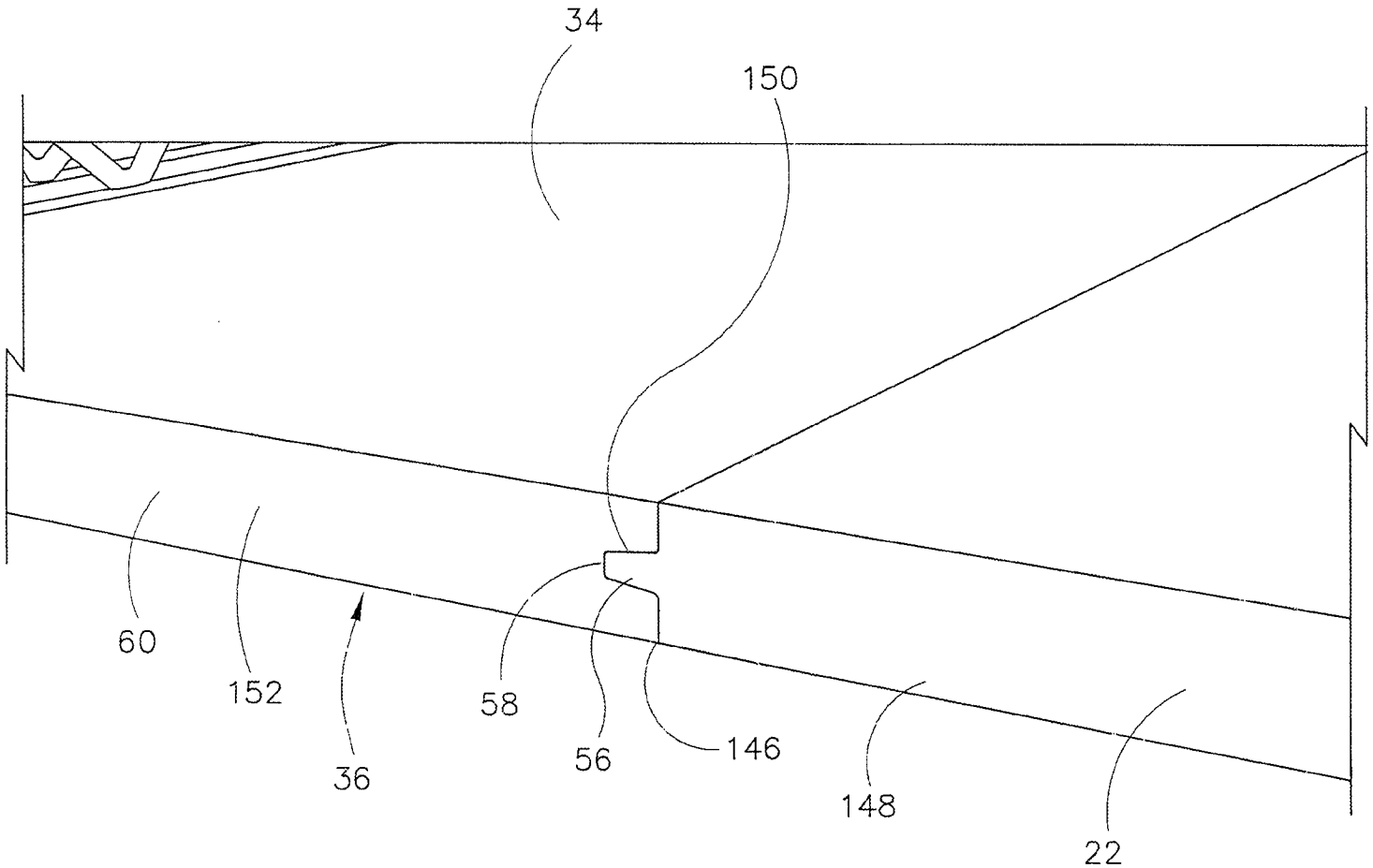
FIG. 23 is a cut away perspective view of an embodiment of the formwork assembly showing the interaction of the form members of FIGS. 17 and 18 in an embodiment of the formwork system.
Figure 24:
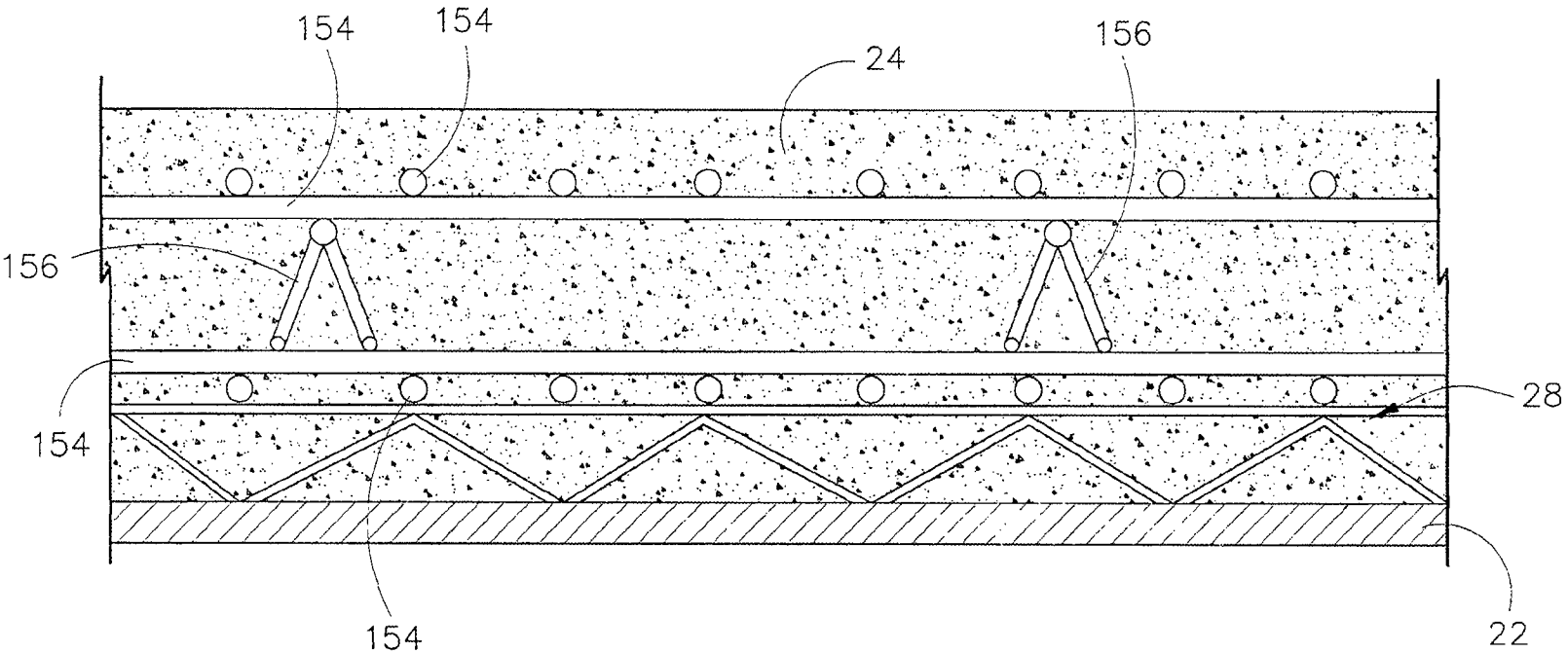
FIG. 24 is a cross-sectional view of a floor having structural reinforcements in an embodiment of the flooring system.

Turning to FIGS. 21-23, form members 22, 60 of an embodiment having a tongue and groove arrangement are specifically illustrated. A first form member 22 is provided having a tongue 56. A second form member 60 is provided having a groove 58 which mates with and/or interlocks with the tongue 56. The first form member 22 is placed in contact with the second form member 60 by engaging the tongue 56 with the groove 58. Subsequently, one or more fasteners 70 may be used to connect the form members 22, 60 together, although fasteners are not required. Each form member 22 or 60 may comprise more than one tongue 56 or more than one groove 58. Likewise, the first form member 22 and/or the second form member 60 may comprise both a tongue 56 and a groove 58. In a preferred embodiment, each form member 22 comprises a first edge 146, a second edge 148, a third edge 150, and a forth edge 152. The tongue 56 is positioned on at least one of the first edge 146, the second edge 148, the third edge 150, and/or the fourth edge 152 of at least one of the form members 22, 60. Likewise, the groove 58 is positioned on at least one of the first edge 146, the second edge 148, the third edge 150, and/or the fourth edge 152 of at least one of the form members 22, 60. Additional form members having tongues and/or grooves may be engaged or interlocked to form a form assembly with a plurality of interlocked form members having a uniform appearance. The tongue 56 and groove 58 arrangement of the form members provides for an integral assembly of a plurality of form members, making assembly both easy and efficient.

The combined assembly 26 may further include additional structural components, such as rebar rods, or a web or mesh of such structural material. As is common in the assembly of concrete structures, a web or mesh of support rods, such as rebar, may be provided, which in the fully assembled structure, is surrounded by concrete 24 and provides additional structural strength to the assembly. This web of structural support rods may be attached by fastening clamps or other means commonly known in the art. The reinforcement structure (see FIG. 20) or specific steel reinforcement structure and the elements and layout thereof is preferably defined by the structural load or design requirements. Likewise, connector bars may be placed in the foundation and/or floor slab on which bearing walls may be placed that will provide an integral structure between the walls and the floor or foundation. Piping and conduits for potable water, wastewater, energy and other electromechanical components may be included in the final assembly.

The fully assembled formwork assembly 26 may be transported to a building site for final positioning and assembly of the floor 20 or ceiling. In at least one embodiment, the formwork assembly is positioned upon the permanent structural supports, such as the beams or walls of a corresponding building section. Spaced provisional structural supports may also be used to support the floor formwork. The provisional supports are preferably used during the placement of any reinforcement steel structures additionally required by the structural design, and/or the placement of any electrical and/or electromechanical elements, and/or the placement of other accessory elements, and the pouring and casting of the concrete slab. Once the slab is casted, the provisional supports may be removed.

A flowable material 24 is placed on the formwork assembly 26 which ultimately forms the floor or ceiling. The material may comprise concrete, cement, liquid, gas, or other substance, or any combination thereof. Preferably, the flowable material is a cement or concrete having the characteristics defined by the structural design. The mixture placed within the assembly is fluid during its introduction into the assembled formwork assembly 26 to allow ease of flow into the assembled structure. The flowable material 24 may comprise a wide variety of known and currently used commercial concrete mixtures or other substances having the properties needed for the purposes desired by the assembler and/or manufacturer. Likewise, the concrete 24 formulation will vary depending upon local cement or concrete characteristics which may define the type of concrete used. Local conditions, such as temperature and moisture at the time of pouring may also have influence on concrete formation. Accordingly, the concrete 24 is prepared to meet the applicable conditions.

In this assembly, it is not necessary to remove the form member(s) 22 or reinforcement beams 28 once the concrete begins to solidify as in other concrete forming systems. The form member 22, reinforcement beam 28, and assembly 26 itself contribute to the structural strength and rigidity of the floor 20. As a result of the combined assembly, the floor 20 is able to bear or support a significant load.

The method of assembly and use of the formwork system to create a floor 20 will now be described in further detail herein. In a preferred embodiment, one or more form members 22 are provided. The form members 22 may be created having one or more grooves 48, 50 thereon. Preferably, a plurality of grooves 48, 50 are provided on at least one, and preferably, a plurality of form members 22, 60. The grooves may be integrally formed in the form member 22 and/or 60 during the preparation of the form, through molding or other means. Alternatively, the grooves 48, 50 may be cut or routed in the form member. As a result, faun members 22 can be created for the specific purpose of attaching one or more reinforcement members 28. Alternatively, standard form members may be obtained from commercial suppliers and routed or modified to suit the individual project or building requirements. In a preferred embodiment, form members 22 are provided with a plurality of grooves 48, 50 having the dimensions set forth above.

One or more reinforcement beams 28 are also provided. Reinforcement beams 28 having the properties defined hereinabove may be integrally molded, or may be assembled by welding, adhesive or other means known in the art. The reinforcement beams 28 may be made of any length, may be cut to specific dimensions, or alternatively, may be formed into the precise dimensions required for the particular form.

The reinforcement beam(s) 28 are applied to the form member 22, and preferably, seated into the grooves 48, 50 in the form member 22. More specifically, the second longitudinal member 40 and the third longitudinal member 44 are seated, respectively, within the first groove 48 and the second groove 50 of the form member 22. The reinforcement beam 28(s) may be slid into the desired location, or positioned and directly inserted in a specific attachment position.

Once the reinforcement beam(s) 28 is oriented in the desired position, one or more clips or attachment members 76, if needed, are positioned within opening(s) of the reinforcement beam 28 and secured to the form member 22 by fasteners 86, such as threaded screws, adhesive, welding, or other means known in the art. Namely, the clip or attachment member 76 is positioned over the second longitudinal member 40 and/or the third longitudinal member 44 of the reinforcement beam 28, and between these longitudinal members and the first longitudinal member 38 which is positioned a distance away from same. In a preferred embodiment, a plurality of attachment members 76 are positioned in a plurality of openings 140, the ends of each attachment member 76 extending beyond the outer sides 80, 82 of the reinforcement beam(s) 28. A first opening 84 in an end of the attachment member 76 receives a fastener 86, which is inserted into the opening 84 and secured to the form member 22. A second opening 84 in an end of the attachment member 76 receives a fastener 86, which is inserted into the opening and secured to the form member 22. As a result of the securing of the attachment member 76 to the reinforcement beam 28, and the fastening of the attachment member 76 to the form member 22, the reinforcement beam 28 is secured in position on the form member 22. The foregoing assembly'26 results in the monolithic attachment of one or more reinforcement beams 28 to one or more form members 22, forming a single building component comprising a formwork assembly 26 that can be transported to the construction site or constructed on site. The assembly may be hoisted into position using the attached reinforcement beam(s) 28. Additional reinforcement material, such as a mesh or web of rebar rods, or other structural components, may be added to the formwork assembly 26 to increase the strength of the combined assembly.

Alternatively, a formwork assembly 26 may be created in which one or more reinforcement beams 28 are provided in association with a molding device for a form member 22. Namely, one or more reinforcement beams 28 may be molded integrally into the form member 22 in the desired location as it is created. As a result, a uniform or single building component having all of the desired characteristics is created.

Once a formwork assembly 26 having a form member 22 and at least one reinforcement beam 28 attached thereto is created, a flowable material 24, such as concrete, may be added to the assembled structure. Specifically, concrete 24, in a fluid form, may be added to the form member 22 on either the contact surface 30 or the opposite surface 36. The concrete 24, in a preferred embodiment, in addition to substantially contacting the surface of the form member 22, may engulf or substantially surround the reinforcement beam(s) 28 positioned on the form member 22. The concrete 24 cures and hardens in place upon the assembly, forming a complete floor structure 20 having one or more form members 22, attached reinforcement beam(s) 28, and concrete 24, which structure has significant strength and rigidity. The floor structure 20 may be further integrated to the foundation and/or wall structures. Moreover, the size or thickness of the floor 20 may be varied to greater or lesser dimensions through variation of the size and shape of different components described herein. Additionally, as described above additional structural support members, such as rebar, may be added prior to introduction of the flowable substance to further strengthen the floor. As is shown in FIG. 20, an example of a formwork assembly having additional structural support elements is provided. As can be seen from FIG. 20, the form member 22 having an attached reinforcement beam 28 supports an additional web or mesh of perpendicularly arranged structural reinforcements, such as rebar rods 154. Spacers 156 may be used to space apart a plurality of structural support rods or members 154. Concrete 24 engulfs the structural support members 154 and 156 as well as the reinforcement beam 28 all of which are positioned on one side of a form member 22. As a result, a floor of significant strength is created. It is noted that additional components, and/or alternative arrangements, or fewer components may be used to create the floor and the foregoing discussion presents only an example of one embodiment.

The installation and assembly of a floor 20 with the foregoing components requires minimal time and effort as the assembler must simply attach the reinforcement beam(s) 28 to the form member(s) 22 and align and/or assemble the form members. The formwork assembly is preferably assembled at the manufacturing facility, but may be formed on the building site depending upon the user's or assembler's preference. Assembled formwork assemblies 26, comprising form members 22 with attached reinforcement beams 28, may be placed in transporting racks and transported to a building site. They can be hoisted and placed in their corresponding position on the foundation, and further connected to adjacent structures, such as walls. A transportable formwork assembly 26 may comprise a plurality of form members 22 with reinforcement beams 28. Additional elements may be included based upon manufacturer's and/or user's desires and capabilities. Preferably, the additional structural elements may be positioned on the assembly at the building site. In a preferred embodiment the formwork assemblies are transported to the building site and hoisted into the specific desired position. As a result, the assembly and method described herein save significant time, effort and cost in the construction of a load bearing structure. More specifically, once the formwork assembly 26 is placed in its final location, provisional supports and studs, as are commonly used in floor construction, needed to support the formwork slab and unhardened concrete are placed below the formwork assembly 26. The number and spacing of the provisional supports and studs is defined by the thickness of the specified formwork assembly and load bearing requirements of the supports. Subsequently, structural steel reinforcements as specified by the specific design, and the mechanical installations for same, are placed over the supported formwork assembly 26. Concrete is then poured over the supported assembly, which when hardens forms the floor 20.

In the foregoing system and devices, flooring is assembled by means of a unique structural support system which may have a variety of dimensions according to the requirements of the site, the manufacturer and/or the user, permitting great versatility in the design. The formwork floors formed by the system and method described comprise a high performance and efficient building solution that is capable of safely withstanding strains produced by static and dynamic loads acting on structural floors and/or ceilings.

Several advantages are gained by the foregoing system and method. The floor formwork system is capable of supporting its own weight and the weight of the concrete slab placed thereon, ensuring that the formwork and floor remains within allowable values established by the specified structural calculations. Likewise, the separation of the provisional supports from the formwork assembly 26 facilitates simultaneous operation in for example a lower floor. The steel beams of the reinforcement members impart structural reinforcement to support the strains generated by the handling and hoisting of the formworks, preventing the occurrence of deflections that might compromise the integrity of the components or assembly. Additionally the reinforcement beams operate as separators of the structural reinforcement material, or rebar, required in many assemblies for the concrete slab. The design and manufacturing of the formwork assembly under controlled plant conditions may further lead to considerable economy in labor and the reduction of mistakes, material waste and occupational safety risks. Likewise, shipping costs are also lowered. In plant element manufacturing also nearly eliminates on-site material storage requirements, reducing inventory and storage costs. Finishing costs are also minimized, as the surface corresponding to, for example, the top of a lower floor is smooth and ready for finishing.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, counterclockwise, x-axis, y-axis, and z-axis) are only used for identification purposes to aid the reader's understanding of the embodiments of the present invention, and do not create limitations, particularly as to the position, orientation, or use of the invention unless specifically set forth in the claims. Jointer references (e.g., attached, coupled, connected) are to be construed broadly and may include intermediate members between a connection of elements and relative movement between elements. As such, jointer references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The following paragraphs enumerated consecutively from 1 through 40 provide for various aspects of the present invention. In one embodiment, in a first paragraph (1), the present invention pertains to a wall board assembly comprising:

1. A floor formwork system comprising:

a form member having a contact surface; and a reinforcement beam monolithically attached to the contact surface of the form member.

2. The floor formwork system of paragraph 1, wherein the reinforcement beam comprises a geometrical configuration conveying rigidity to the formwork.

3. The floor formwork system of either of paragraphs 1 or 2, wherein the reinforcement beam is attached to the contact surface by adhesive.

4. The floor formwork system of any of paragraphs 1 through 3, wherein the reinforcement beam is attached to the contact surface by chemical welding.

5. The floor formwork system of any of paragraphs 1 through 4, wherein the reinforcement beam is attached to the contact surface by an attachment member.

6. The floor formwork system of any of paragraphs 1 through 5, wherein the contact surface of the form member comprises a first groove for receiving a portion of the reinforcement beam.

7. The floor formwork system of paragraph 6, wherein the contact surface of the form member comprises a second groove for receiving a portion of the reinforcement beam.

8. The floor formwork system of paragraph 6, wherein the groove longitudinally extends from a first end of the foil member to a second end of the form member.

9. The floor formwork system of any of paragraphs 1 through 8, wherein the reinforcement beam extends from a first end of the form member to the second end of the form member and is positioned in the longitudinally extending groove from a first end of the groove to a second end of the groove.

10. The floor formwork system of any of paragraphs 1 through 9, wherein the form member comprises fiber cement.

11. The floor formwork system of any of paragraphs 1 through 10, wherein the reinforcement beam extends from a first end of the form member to a second end of the form member.

12. The floor formwork system of any of paragraphs 1 through 11, comprising a plurality of reinforcement beams attached to the form member.

The floor formwork system of any of paragraphs 1 through 12, comprising a plurality of form members.

14. The floor formwork system of paragraph 13, wherein the plurality of form members are positioned and connected by a tongue of a first form member mating with a groove of a second form member.

15. The floor formwork system of any of paragraphs 1 through 14, wherein the reinforcement beam comprises:

a first longitudinal member;

a second longitudinal member;

a third longitudinal member;

a first diagonal support member extending from the first longitudinal member to the second longitudinal member;

a second diagonal support member extending from the first longitudinal member to the third longitudinal member.

16. The floor formwork system of any of paragraphs 1 through 15, wherein the first longitudinal member is spaced a distance from the form member.

17. The floor formwork system of any of paragraphs 1 through 16, wherein the second longitudinal member is positioned in a first groove on the form member.

18. The floor formwork system of any of paragraphs 1 through 17, wherein the third longitudinal member is positioned in a second groove in the form member.

19. The floor formwork system of paragraph 15, further comprising an attachment member positioned in operable connection with the reinforcement beam and the form member, the attachment member comprising a clip extending across the second longitudinal member and the third longitudinal member and being fastened to the form member.

20. The reinforcement member of paragraph 15, further comprising a chemical welding attachment of at least one of the longitudinal members to the form member.

21. A reinforcement member for a floor comprising:

a first longitudinal member;

a second longitudinal member;

a third longitudinal member;

a plurality of first diagonal support members extending from the first longitudinal member to the second longitudinal member;

a plurality of second diagonal support members extending from the first longitudinal member to the third longitudinal member.

22. The reinforcement member of paragraph 21, further comprising an attachment member for attachment to a planar structure.

23. The reinforcement member of either of paragraphs 21 or 22, wherein the plurality of diagonal support members form a linear repeating pattern of triangular struts.

24. The reinforcement member of any of paragraphs 21 through 23, wherein the first longitudinal member, the second longitudinal member and the third longitudinal member form a triangular support.

25. A reinforcement member for a floor comprising:

a first longitudinal member;

a second longitudinal member;

a third longitudinal member;

a fourth longitudinal member;

a plurality of first diagonal support members extending from the first longitudinal member to the second longitudinal member;

a plurality of second diagonal support members extending from the second longitudinal member to the third longitudinal member; and a plurality of third diagonal support members extending from the third longitudinal member to the fourth longitudinal member.

26. A reinforcement member for a floor comprising:

a first longitudinal member;

a second longitudinal member;

a third longitudinal member;

a fourth longitudinal member; and an inner rectangular reinforcement attached to a first longitudinal member, the second longitudinal member, the third longitudinal member, and the fourth longitudinal member.

27. A clip and rod formwork assembly comprising:

a form member having a first side and a second side;

a plurality of integrally connected rods operably attached to the form member to provide structural strength to the form member;

a clip member operably seated for retaining the plurality of rods on the form member.

28. A floor comprising:

a form member having a first side and a second side;

a reinforcement member having a first longitudinal member spaced a distance from the first side of the form member and a second longitudinal member operably connected to the first longitudinal member and seated in the form member; and concrete placed in contact with the form member and reinforcement member.

29. The floor of paragraph 28, further comprising a third longitudinal member operably connected to the first longitudinal member and seated in the form member.

30. The floor of paragraph 28, further comprising an attachment member securing the reinforcement member to the form member.

31. A method of forming a formwork assembly comprising:

providing a form member having at least one groove;

providing a reinforcement member capable of being positioned in the at least one groove;

positioning the reinforcement member in contact with the form member, seating at least a portion of the reinforcement member in the at least one groove; and securing the reinforcement member to the form member.

32. The method of paragraph 31, wherein the reinforcement member is secured to the form member by an attachment member.

33. The method of either of paragraphs 31 or 32, wherein the form member comprises a plurality of grooves.

34. The method of paragraph 33, wherein the reinforcement member comprises two longitudinal members for seating within the grooves of the form member.

35. The method of any of paragraphs 31 through 34, further comprising providing a plurality of form members.

36. The method of paragraph 35, wherein the plurality of form members are adjacently attached by means of a tongue and groove.

37. The method of paragraph 36, further comprising a plurality of reinforcement members.

38. A method of forming a floor comprising:

providing a form member having at least one groove;

providing a reinforcement member capable of being positioned in the at least one groove;

positioning the reinforcement member in contact with the form member, seating at least a portion of the reinforcement member in the at least one groove;

securing the reinforcement member to the form member; and placing concrete in contact with at least one of the form member and the reinforcement member.

39. The method of paragraph 38, further comprising providing additional structural reinforcement material in operable contact with the form member.

40. The method of either of paragraphs 38 or 39 further comprising electromechanical and functional accessories.

Although the present invention has been described with reference to preferred embodiments, persons skilled in the art will recognize that changes may be made in form and detail without departing from the spirit and scope of the invention.

We claim:

1. A floor formwork system comprising:

a form member having a contact surface; and a reinforcement beam attached to the contact surface of the form member, the reinforcement beam comprising:

a first longitudinal member that is substantially straight;

a second longitudinal member that is substantially straight;

a third longitudinal member that is substantially straight;

a first support member having a top portion connected to the first substantially straight longitudinal member and a bottom portion connected to the second substantially straight longitudinal member; and a second support member having a top portion connected to the first substantially straight longitudinal member and a bottom portion connected to the third substantially straight longitudinal member;

wherein the second and third substantially straight longitudinal members are attached to the form member by insertion within longitudinal grooves in the contact surface, the longitudinal grooves comprising a depth and width each corresponding to a diameter of the second longitudinal member and the third longitudinal member; and wherein the first substantially straight longitudinal member is oriented parallel to and is spaced above the second and third substantially straight longitudinal members by the first and second support members, relative to the form member.

2. The floor formwork system of claim 1, wherein the first and second support members of the reinforcement beam each comprises a triangular web geometrical configuration conveying rigidity to the floor formwork.

3. The floor formwork system of claim 1, wherein the reinforcement beam is attached to the contact surface by adhesive applied between the second and third substantially straight longitudinal members and the form member, within the grooves.

4. The floor formwork system of claim 1, wherein the reinforcement beam is attached to the contact surface of the form member by chemical welding inside the grooves.

5. The floor formwork system of claim 1, wherein the reinforcement beam is attached to the contact surface by an attachment member positioned over the second and third substantially straight longitudinal members and below the first substantially straight longitudinal member, relative to the form member.

6. The floor formwork system of claim 1, wherein the form member comprises fiber cement.

7. The floor formwork system of claim 1, wherein the reinforcement beam extends from a first end of the form member to a second end of the form member.

8. The floor formwork system of claim 1, comprising a plurality of said reinforcement beams oriented in parallel and attached to the form member within the grooves.

9. The floor formwork system of claim 1, comprising an integral assembly of a plurality of said form members.

10. The floor formwork system of claim 9, wherein the plurality of form members are positioned and connected into the integral assembly by a tongue of a first form member of the plurality of form members mating with a groove of a second form member of the plurality of form members.

11. The floor formwork system of claim 1, wherein:

the first support member comprises a first diagonal support member extending from the first substantially straight longitudinal member to the second substantially straight longitudinal member; and the second support member comprises a second diagonal support member extending from the first substantially straight longitudinal member to the third substantially straight longitudinal member.

12. The floor formwork system of claim 11, wherein the first substantially straight longitudinal member, the second substantially straight longitudinal member, and the third substantially straight longitudinal member are positioned in a triangular cross-sectional configuration.

13. The floor formwork system of claim 11, wherein the second substantially straight longitudinal member is positioned in a first longitudinal groove of the form member.

14. The floor formwork system of claim 13, wherein the third substantially straight longitudinal member is positioned in a second longitudinal groove in the form member, the second longitudinal groove spaced apart from the first longitudinal groove.

15. The floor formwork system of claim 11, further comprising an attachment member positioned in operable connection with the reinforcement beam and the form member, the attachment member comprising a clip extending across and over the second substantially straight longitudinal member and the third substantially straight longitudinal member and below the first substantially straight longitudinal member with respect to the form member, the clip being fastened to the contact surface of the form member.

16. The floor formwork of claim 14, further comprising a chemical welding attachment of the second and third substantially straight longitudinal members inside the grooves on the contact surface of the form member.

17. The floor formwork system of claim 1, further comprising a clip member operably seated by mechanical fastening to the contact surface for retaining the second and third longitudinal members on the form member.

18. A floor formwork system comprising:

a form member having a contact surface; and a reinforcement beam attached to the contact surface of the form member, the reinforcement beam comprising:

a first longitudinal member that is substantially straight;

a second longitudinal member that is substantially straight;

a third longitudinal member that is substantially straight, wherein at least one of the second and third longitudinal members is directly attached to the contact surface of the form member by insertion within a first longitudinal groove in the contact surface, and the first longitudinal member is oriented parallel to and is raised higher than the second and third longitudinal members, relative to the form member; and wherein the first longitudinal groove in the contact surface of the form member receives by said insertion the full depth of the at least one of the second and third longitudinal members of the reinforcement beam, the first longitudinal groove comprising a depth and width each corresponding to a diameter of the at least one of the second and third longitudinal members.

19. The floor formwork system of claim 18, wherein the contact surface of the form member comprises a second longitudinal groove for receiving at least partial insertion of the other of the second or third longitudinal members of the reinforcement beam.

20. The floor formwork system of claim 18, wherein the first longitudinal groove extends from a first end of the form member to a second end of the form member.

21. The floor formwork system of claim 20, wherein the reinforcement beam extends from a first end of the form member to the second end of the form member and is positioned in the first longitudinal groove from a first end of the groove to a second end of the groove.

* * * * *

UNITED STATES PATENT AND TRADEMARK OFFICE

CERTIFICATE OF CORRECTION

PATENT NO. : 8,707,644 B2
APPLICATION NO. : 13/450868
DATED : April 29, 2014
INVENTOR(S) : Ronald Jean Degen et al.

It is certified that error appears in the above-identified patent and that said Letters Patent is hereby corrected as shown below:

SPECIFICATION:

At column 5, line 56 "the second foam member 60" should be --the second form member 60--
At column 7, line 29 "beam 28 to the faun member 22" should be --beam 28 to the form member 22--
At column 7, line 34 "directly to the foam member" should be --directly to the form member--
At column 8, line 2 "embedded within the Run member" should be --embedded within the form member--
At column 11, line 23 "faun member 22. In other words," should be --form member 22. In other words,--
At column 12, line 57 "As a result, faun members 22" should be --As a result, form members 22--
At column 13, line 36 "The foregoing assembly'26 results" should be --The foregoing assembly 26 results--

CLAIMS:

At column 16, claim 8, line 21 "from a first end of the foil" should be --from a first end of the form--

Signed and Sealed this
Twenty-second Day of July, 2014

Michelle K. Lee

Michelle K. Lee
*Deputy Director of the United States Patent and Trademark Office*